United States Patent [19]

Chano et al.

[11] 4,074,640

[45] Feb. 21, 1978

[54] AUTOMATIC SEWING MACHINE

[75] Inventors: Takashi Chano, Yokohama; Kohji Masuda, Sagamihara, both of Japan

[73] Assignees: Tokyo Juki Kogyo Kabushiki Kaisha; Kayaba Industry Co., Ltd., both of Tokyo, Japan

[21] Appl. No.: 664,038

[22] Filed: Mar. 4, 1976

[30] Foreign Application Priority Data

Mar. 13, 1975 Japan ..... 50-29557
Aug. 20, 1975 Japan ..... 50-101556

[51] Int. Cl.[2] ..... D05B 19/00; D05B 33/00; D05B 35/10

[52] U.S. Cl. ..... 112/121.11; 112/121.29; 112/153; 112/205; 112/272

[58] Field of Search ..... 112/121.11, 121.15, 112/121.12, 121.29, 205, 204, 136, 153; 271/51, 52

[56] References Cited

U.S. PATENT DOCUMENTS

| | | | |
|---|---|---|---|
| 3,204,590 | 9/1965 | Rockerath et al. | 112/121.11 |
| 3,500,780 | 3/1970 | Emus et al. | 112/121.29 |
| 3,609,373 | 9/1971 | Desai | 112/205 X |
| 3,722,441 | 3/1973 | Kitchener | 112/205 |
| 3,776,155 | 12/1973 | Gratsch | 112/205 |
| 3,789,781 | 2/1974 | Carson et al. | 112/121.29 |
| 3,810,436 | 5/1974 | Marforio | 112/121.15 |
| 3,884,166 | 5/1975 | Rinehimer et al. | 112/121.29 |

*Primary Examiner*—H. Hampton Hunter
*Attorney, Agent, or Firm*—Wenderoth, Lind & Ponack

[57] ABSTRACT

An automatic sewing machine includes a sewing machine mechanism having a seam forming mechanism and a fabric feed mechanism. A detector member senses the position of each free side edge of two layers of fabric to be fed to the seam forming mechanism and generates signals. A pair of manipulators capable of engaging each layer of fabric individually move such each layer of fabric to a predetermined position in response to signals from the detector members. The free side edges of layers of fabric are automatically stitched together by a predetermined distance along the free side edges with the edges maintained in alignment with each other.

8 Claims, 24 Drawing Figures

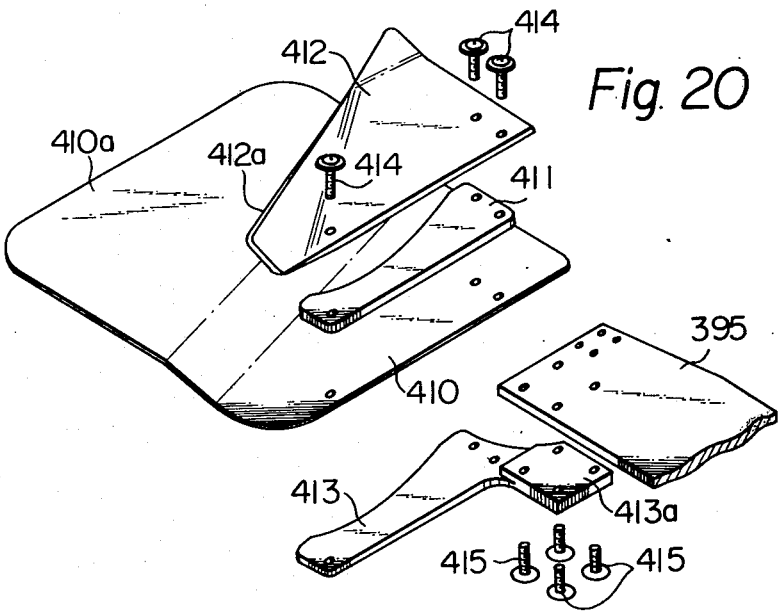
Fig. 20
Fig. 22
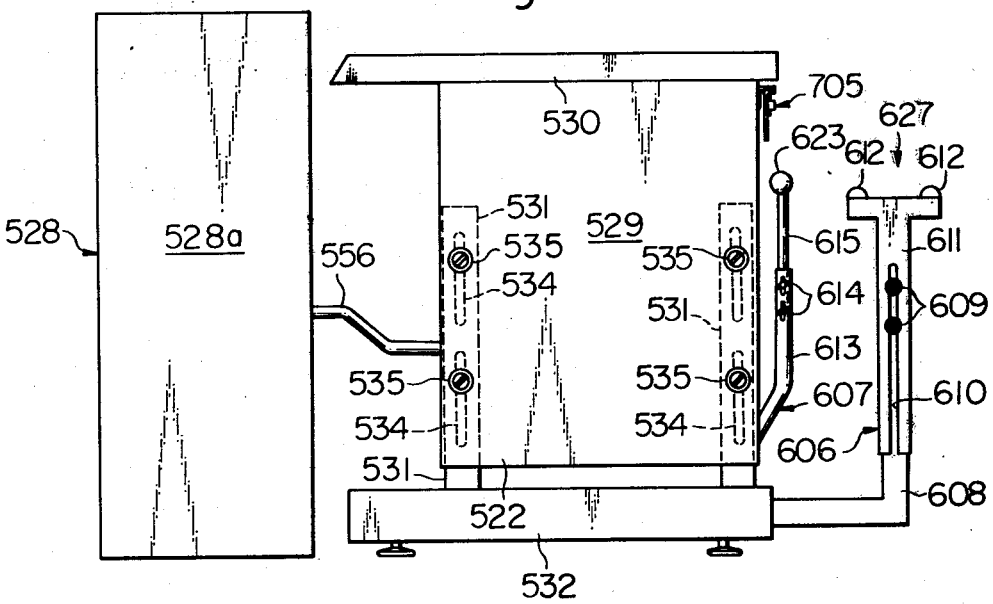

AUTOMATIC SEWING MACHINE

BACKGROUND OF THE INVENTION

This invention relates to an automatic sewing machine for automatically stitching free side edges of work pieces of flexible material while properly positioning the free side edges of the work pieces.

When overedge stitching is performed on a work piece, or when free side edges of two superposed layers of fabric are stitched together by a predetermined distance along the side edges while the side edges are aligned with each other, it is difficult to properly feed the fabric with respect to the sewing machine mechanism. Especially, when two free side edges having different configurations are to be stitched continuously in a high speed sewing machine such as an industrial sewing machine while the free side edges are aligned with each other, such an operation in a high speed sewing machine is almost impossible. In such operation, it has been a conventional practice that a machine operator intermittently stitches free side edges of layers of fabric together while manually aligning succesive portions of the edges with each other, but this conventional operation consumes a great deal of time and labor. Of course, in a sewing machine exclusively designed for attaching a collar or cuff to the body of a garment, various attempts have been made to perform such operation automatically, but the conventionally proposed automatic stitching processes can not accomodate a great variety of fabric configurations and lack versatility.

SUMMARY OF THE INVENTION

With the above in mind, the purpose of the present invention is to provide an automatic sewing machine which can automatically stitch free side edges of two superposed layers of fabric together by a predetermined distance along the edges while automatically aligning the edges with each other even if the edges have different configurations.

The present invention is applicable to a great variety of sewing operations such as overedge stitching or stitching free side edges of two superposed layers of fabric together while aligning the edges with each other. A specific embodiment of the present invention is suitable for stitching free side edges of two superposed layers of fabric together while aligning the edges with each other. The preferable embodiment of the invention comprises an automatic sewing machine including a sewing machine mechanism, a positioning device including in combination a detector member for sensing a free side edge of each layer of fabric to be sewn and a terminal edge of the sewn fabric and a manipulator member for individually moving each layer of fabric leftwards or rightwards in response to signals from the detector member, auxiliary devices such as an auxiliary guide and an air table for maintaining layers of fabric to be sewn together in a proper position as much as possible with respect to the sewing machine mechanism, a stacker on which successively sewn fabric products are stored, and a controller controlling the movement of the positioning device and stacker and the operation timing of the sewing machine mechanism.

According to one preferred embodiment of the present invention, the controller comprises an electric circuit which generates command signals in accordance with a predetermined program and is related to the sewing machine mechanism so as to allow the sewing machine mechanism to perform an automatic sewing cycle as illustrated by preferred embodiments of which description will be made hereinafter. The controller receives a start signal after two layers of fabric to be sewn together have been fed to a predetermined position, provides a descent signal to the presser foot of the sewing machine mechanism to cause the presser foot to descent so as to hold the layers of fabric down and then commands the sewing machine mechanism to perform a cycle of backward sewing at low speed. The number of stitches in this low speed backward sewing operation is counted by the controller and when a predetermined number of stitches has been counted, the controller now commands the sewing machine mechanism to initiate a forward sewing cycle at high speed and at the same time, commands the positioning device to operate.

The detector member and manipulator means are mounted on the sewing machine mechanism in a predetermined position with respect to the needle center. During the high speed forward sewing operation, the detector member individually senses each free side edge of two superposed layers of fabric to determine whether the free side edges are positioned in a proper position spaced by a predetermined distance from the needle center and converts the sensed result into electrical signals. The manipulator means operates in response to signals from the detector member and during the operation of the manipulator means, the manipulator means individually controls each free side edge of the layers of fabric so as to space the edges by the predetermined distance from the needle center. The positioning and position control of free side edges of two layers of fabric are not only useful for eliminating manual effort on the part of the machine operator during the high speed forward sewing, but also allow the sewing machine to continuously operate to thereby substantially improve operation efficiency. In this way, the combination of the detector member and manipulator means is an important feature of the present invention.

When fed to the predetermined position, the two layers of fabric are further fed in a predetermined direction by the feed machanism as a particular forward high speed sewing cycle proceeds. In this case, when the fabric has a relatively great weight due to a relatively large size and/or thickness, the right-hand side of the fabric tends to advance at a speed greater than that at which the left-hand side of the same fabric proceeds. In such a case, it can not be expected that the fabric is fed properly by the action of only the feed mechanism, and as a result the fabric is always subjected to a rotation moment which causes the fabric to rotate in the counter-clockwise direction about the portion of the fabric which faces the feed mechanism, and such rotation moment deteriorates the controlling action on the free side edge position by the manipulator means. In order to eliminate such difficulty, according to the present invention, for counteracting such counter-clockwise rotation of the fabric, auxiliary guide means and an air table are provided in the sewing machine mechanism for operation in coordination with the operation of the feed mechanism. The auxiliary guide means is provided at the front side edge of the table of the sewing machine mechanism. As the fabric is fed by the feed mechanism, the guide means pushes the right-hand side edges of layers of fabric to impart resistance to the fabric, and at the same time the leftwardly slanted front edge of the guide means always guides the fabric leftwards to impart a clockwise rotation moment to the fabric to thereby reduce the counter-clockwise rotation moment acting on the fabric by the feed mechanism. The air table is flush with the upper surface of the table of the machine mechanism and serves to reduce friction generated between the table surface and fabric by air flowing out of holes in the air table, whereby the feed of the fabric is smoothed. The air holes slant leftwards with respect to the fabric feed direction to provide air flow in at a leftwardly slanted direction so as to urge the fabric leftwards to thereby reduce the counter-clockwise rotation moment acting on the fabric in cooperation with the guide. In this way, during a particular sewing cycle, the fabric is fed while maintaining its proper orientation by the co-action of the auxiliary guide means and air table and by the positive controlling action on the fabric free side edges by the manipulation means. This is also an important feature of the present invention.

The termination of the high speed forward sewing cycle is effected by sensing the terminal end of the sewn fabric by means of the detector member. The sensed result of the detector member is provided to the controller in the form of an electric signal to command the sewing machine mechanism to shift to its low speed forward sewing mode. The number of stitches made during this low speed forward sewing cycle is also counted by the counter and when a predetermined number of stitches has been counted, the controller provides an operation signal to the thread cutting mechanism in the sewing machine mechanism to cause the cutting mechanism to cut the thread. Simultaneously, the controller initiates its stitch counting function and after a predetermined time space has elapsed, the controller provides an operation signal to the stacker whereupon the entire sewing machine returns to its initial position to thereby complete one cycle of the sewing operation and is ready for the next cycle of operation.

According to the present invention, the operator is only requested to feed the fabric into the machine and provide a start signal to the machine for setting the machine into motion to perform a particular sewing cycle including proper sewing of fabric, product removal and stacking. The coordination of the movement timing of the positioning device and stacker with that of the sewing machine mechanism is another feature of the present invention. Furthermore, according to the present invention, assuming that any error may occur during a particular sewing cycle, means is provided for interrupting the operation of the machine at such a time, and means is also provided for performing the sewing sequence step by step.

In addition, according to the present invention, a control box including an operation knob, an adjusting knob and an instrument is formed as a structure separate from the sewing machine mechanism, and the control box controls the operation of the various elements of the sewing machine mechanism by connecting the control box and sewing machine mechanism by a cable. In this way, the control box can be repositioned depending upon the operator's posture to thereby maintain the operation performance of the machine at an optimum state and contribute to improving the performance under all conditions. Still furthermore, according to the present invention, the height of the table and stacker of the sewing machine mechanism is adjustable and by adjusting the height of the table and stacker, depending upon the operator's posture, fatigue on the part of the operator can be substantially reduced.

The above and other objects and attendant advantages of the present invention will be more readily apparent to those skilled in the art from the following description in conjunction with the accompanying drawings which show preferred embodiments of the present invention for illustration purposes only, but which do not limit the scope of the invention in any way.

BRIEF DESCRIPTION OF THE DRAWINGS

FIGS. 17–21 are views of a second embodiment of fabric positioning device of the sewing machine, wherein FIG. 18 is a cross-sectional view of the fabric positioning device;

FIG. 19 is a vertically sectional view of the upper manipulator means;

FIG. 20 is an exploded perspective view of the separator plate;

FIG. 21 is a longitudinally sectional view of essential parts of the fabric positioning device;

FIGS. 22 and 23 are views showing second embodiments of machine table, control box and stacker, in which FIG. 22 is a side elevational view similar to FIG. 2;

FIG. 23 is a rear view on an enlarged scale of the blower; and

DETAILED DESCRIPTION OF THE PREFERRED EMBODIMENTS OF THE INVENTION

Figure 1:
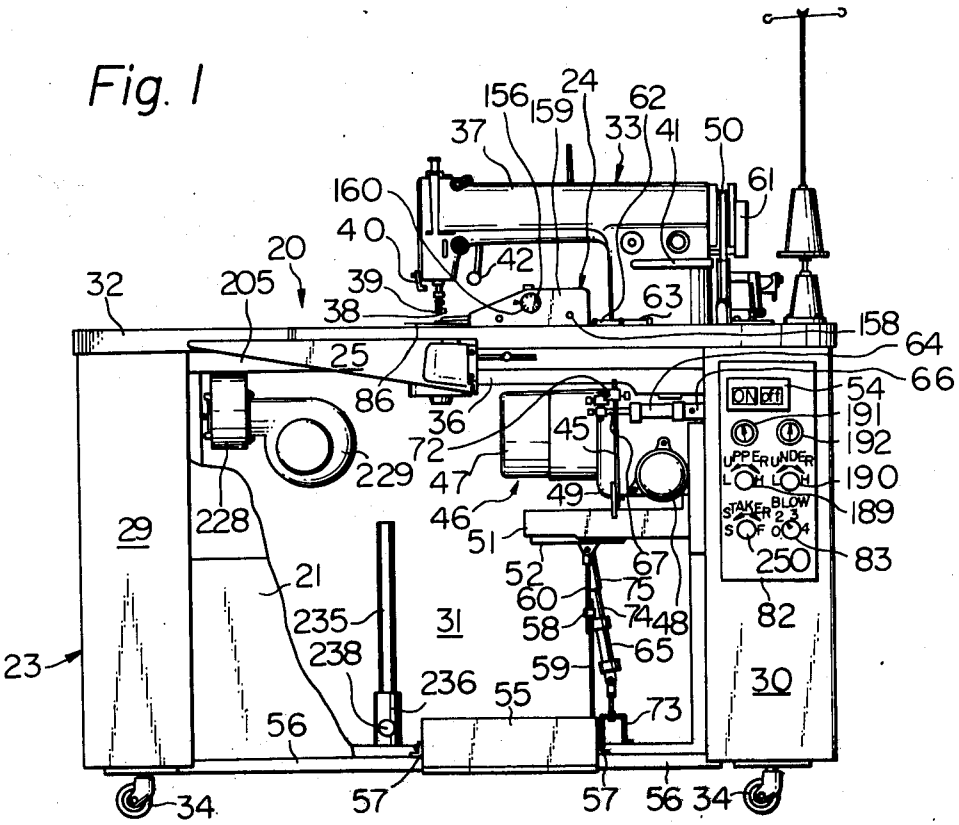
FIG. 1 is a front elevational view of a preferred embodiment of an automatic sewing machine constructed in accordance with the present invention with a portion thereof broken away.
Figure 2:
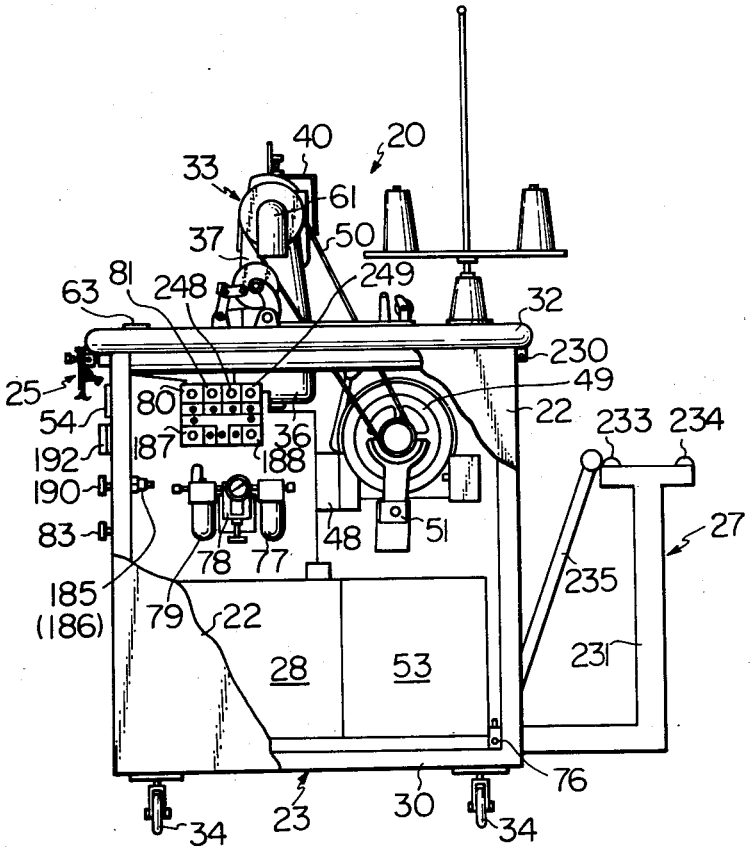
FIG. 2 is a such elevational view of said sewing machine with a portion thereof broken away.
Figure 3:
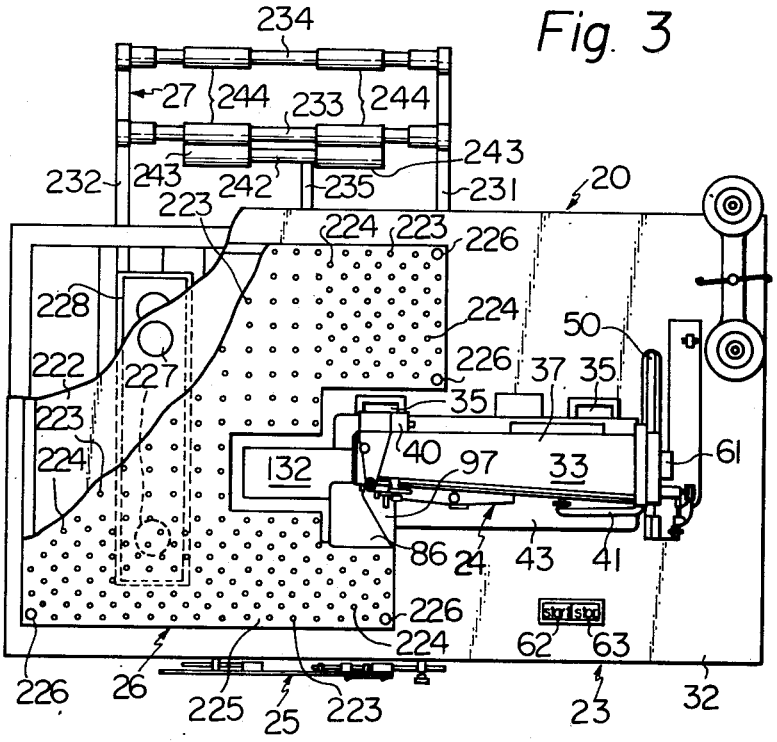
FIG. 3 is a top plan view of said sewing machine with a portion thereof broken away.

The present invention will be now described referring to the accompanying drawings and more particularly, to FIGS. 1 through 3 in which a first embodiment of an automatic sewing machine 20 of the invention is generally shown with its front plate 21 and side plate 22 removed therefrom. The automatic sewing machine 20 essentially comprises a conventional sewing machine mechanism 23 and its associated parts such as a fabric positioning device 24, an auxiliary guide 25, an air table 26, a stacker 27 and a controller 28 which is adapted to control the operation of the positioning device 24, air table 26 and stacker 27 as well as the operation of the sewing machine mechanism 23 in accordance with a predetermined sequence.

As is known in the art, the sewing machine mechanism 23 comprises a sewing head 33 mounted on a table 32 supported on a base 31 which in turn has wings 29, 30 at the opposite ends thereof. The base 31 can freely move by means of castors 34 rotatably mounted on the undersurface of the base at four corners thereof. The sewing head 33 has an oil pan 36 hinged at 35 the lower rear edge and when the oil pan is secured to the table 32, the sewing head 33 is mounted on the table 32 so that the head can be tilted rearwardly with respect to the table. Mounted on the upper portion 37 of the sewing head 33 are a sewing needle 38, a presser foot 39, a thread cutting mechanism 40 and backward sewing levers 41, 42 (the word "backward" refers to the direction opposite to the fabric feed direction). Mounted on the lower portion 43 of the sewing head 33 are a feed dog 44 (see FIG. 6), an under thread mechanism (not shown) and a presser foot lifting lever 45. The above-mentioned parts mounted on the upper and lower portions 37 and 43 of the sewing head 33 cooperate with each other to effect a cycle of the sewing operation.

An electric motor mechanism 46 is provided to impart a predetermined movement to the driven elements of the sewing head 33 and comprises a main motor 47, an auxiliary motor 48 and a clutch 49. The motors 47, 48 and clutch 49 are mounted on the undersurface of the table 32 as a single unit which imparts a predetermined movement to the driven elements of the sewing head 33 through a belt 50. The clutch 49 of the above-mentioned electric motor mechanism 46 comprises an operation lever 51 extending horizontally and leftwards from the clutch (as seen in FIG. 1) and has a switch mechanism 52 therein. The right-hand wing 30 of the base 31 has a control box 53 adapted to control the movement of each of the driven elements of the sewing head 33 and a main switch 54 on the interior and front side of the wing, respectively. A treadle 55 adapted to provide command signals to the control box 53 is rockably mounted by means of a bracket 57 on a bridge 56 which in turn extends between the opposed wings 29, 30 on the base 31. The treadle 55 is connected to the switch mechanism 52 of the clutch operation lever 51 through two connector rods 59, 60 which are connected together by a connector 58 so that the relative position of the rods 59, 60 can be adjusted to vary the length of the combined rods 59, 60. When the treadle 55 is pushed down with a slight force to be rocked back and forth, a switch in the switch mechanism 52 is opened or closed through the connector rods 59, 60, and when the treadle 55 is further pushed down with a greater force to be rocked forwardly, the clutch operation lever 51 is lowered to shift the clutch 49.

In the conventional sewing machine mechanism 23, when the main switch 54 is thrown in, the main motor 47 adapted to drive the sewing machine mechanism at a predetermined high speed starts its rotation. However, at such a time, since the clutch 49 is connected to the auxiliary motor 48 adapted to drive the sewing mechanism at a predetermined low speed, the driven elements of the sewing head 33 have no movement imparted thereto. Then the lever 45 is pushed rightwards to lift the presser foot 39 up and held in position. With the presser foot 39 lifted, two layers of fabric to be sewn together are positioned and set below the presser foot 39 and thereafter, the pushing force applied on the lever 45 is removed therefrom to allow the presser foot 39 to descend down onto the fabric layers to hold them down in cooperation with the underlying feed dog 44. With the fabric held down on the feed dog 44 by the presser foot 39, when the treadle 55 is pushed down forwardly with a light force, a low speed switch in the switch mechanism 52 is closed through the movement of the connector rods 59, 60 in response to the force applied on the treadle 55 and as a result, a low speed sewing relay (not shown) within the control box 53 is actuated to provide a command signal for rotation to the auxiliary motor 48 whereupon a sewing cycle starts.

At the start of a sewing cycle, the backward sewing lever 41 or 42 is usually held in its pushed-down position whereby a feed dog clutch (not shown) is mechanically or electromagnetically shifted to a backward sewing mode. As a result, the feed dog 44 mounted on the lower portion 43 of the sewing head 33 feeds the fabric layers backwards to effect a backward sewing at a low speed. After the backward sewing with a predetermined number of stitches has been made on the fabric, the force on the lever 41 or 42 is removed therefrom whereupon the feed dog clutch is shifted to a forward sewing mode. Therefore, the feed dog 44 begins to feed the fabric in the forward or normal direction and the sewing machine mechanism 23 starts a forward sewing cycle at a low speed. Thereafter, when the treadle 55 is further pushed down with a greater force, the treadle pulls the clutch operation lever 51 downwardly through the connector rods 59, 60 to shift the connection of the clutch 49 from the auxiliary motor 48 to the main motor 47 to start a sewing cycle at a high speed. After a forward high speed sewing has been made along a predetermined length of the fabric layers, when the treadle 55 is pushed down to the low speed sewing position and the backward sewing lever 41 or 42 is pushed, the feed dog 44 feeds the fabric in the backward direction and the connection of the clutch 49 is shifted from the main motor 47 to the auxiliary motor 48 to effect a low speed backward sewing on the fabric by a predetermined number of stitches. Thereafter, when the treadle 55 is further pushed down backwardly, the low speed sewing switch in the switch mechanism 52 is opened and a thread cutting switch is closed whereupon a relay in the control box 53 is actuated. As a result, the control box 53 cooperates with a slip ring 61 mounted on the upper portion 37 of the sewing head 33 in effecting the following control operation while controlling the rotational movement of the auxiliary motor 48. When the sewing needle has reached its predetermined lowermost position, an operation command signal is provided from the control box 53 to the thread cutting mechanism 40 and the thread cutting mechanism effects a thread cutting operation while the sewing needle 38 is moving in its upward stroke. When the needle 38 has reached its uppermost position, the auxiliary motor 48 is stopped. The presser foot lifting lever 45 is pushed to lift the pressure foot 39 and the sewn fabric is removed from the sewing zone to thereby complete a cycle of the sewing operation.

In this way, in the conventional sewing machine mechanism 23 referred to hereinabove, during a sewing cycle, the operator has to selectively operate the presser foot lifting lever 45, backward sewing lever 41 or 42 and treadle 55. Furthermore, especially during a high speed forward sewing cycle, the operator has to manually align the side edges of two superposed layers with each other and at the completion of the sewing cycle, the operator has to manually take the sewn fabrics out of the sewing zone and stack them on a predetermined position. In order to relieve the above manual work load of the operator, according to the present invention, the automatic sewing machine comprises the fabric positioning device 24, the auxiliary guide 25, the air table 26, the stacker 27 and the controller 28 adapted to control the operation of the fabric positioning device 24, air table 26, stacker 27 and sewing machine mechanism 23.

Referring to FIGS. 1 through 3 again, a start button 62 and a stop button 63 are embedded in the upper surface of the table 32 in the sewing machine mechanism 23. When the start button 62 is depressed down, an operation initiation command signal is provided to the control box 53 and controller 28 and thereafter, the controller 28 controls the timing of each operation in the sewing machine mechanism 23. When any error takes place during a sewing cycle, the stop button 63 is depressed down to interrupt the sequence operation at once and also serves as a so-called emergency button which returns the entire sewing machine to its initial position.

Figure 4:
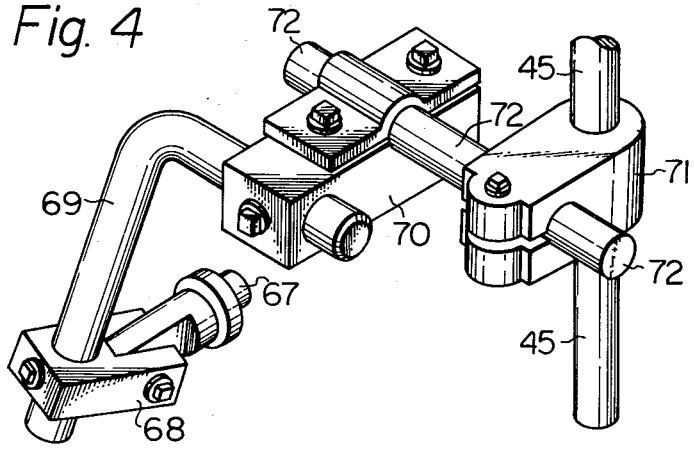
FIG. 4 is a fragmentary perspective view on an enlarged scale of the presser foot actuating lever mechanism of such sewing machine.

In order to automatically effect the vertical movement of the presser foot 39 and the shifting of the clutch 49 in the electric motor mechanism 46 in accordance with operation command signals from the controller 28, air cylinders 64 and 65 are provided in association with the presser foot lifting lever 45 and with the operation lever 51 for the clutch 49, respectively. The air cylinder 64 associated with the presser foot lifting lever 45 has its base hinged to a bracket 66 secured to the inner side of the right-hand wing 30 (as seen in FIG. 1). A piston rod 67 of the air cylinder 64 is hinged to the lower end of a L-shaped sub-lever 69 by means of a connector 68 as more clearly shown in FIG. 4 whereas both the base end of the sub-lever 69 and presser foot lifting lever 45 are secured to a rotary presser foot lifting shaft 72 by means of connectors 70, 71, respectively. Similarly, the air cylinder 65 associated with the operation lever 51 for the clutch 49 has its base hinged to the base 31 of the sewing machine mechanism 23 by means of a bracket 73 and a piston rod 74 of the cylinder 65 is hinged to one or the lower end of a connector 75 depending from the switch mechanism 52 in the cluch operation lever 51. Accordingly, when the air cylinder 64 is retracted, the presser foot lifting lever 45 is rotated in the counterclockwise direction in FIG. 1 to thereby lift the presser foot 39 of the sewing head 33. Similarly, when the air cylinder 65 is retracted, the operation lever 51 is pulled downwardly while holding the low speed sewing switch of the switch mechanism 52 in its closed position to thereby shift the connection of the clutch 49 from the auxiliary motor 48 to the main motor 47. And when the operator operates the presser foot lifting lever 45 and treadle 55 regardless of the air cylinders 64, 65, the air cylinders 64, 65 retract accordingly, the lifting of the presser foot 39 and the operation of the treadle 55 can be manually effected.

Compressed air for operating the air cylinders 64, 65 is supplied by connecting a hose from a compressed air source such as an air compressor (not shown) to a quick joint 76. As more clearly shown in FIG. 2, the quick joint 76 is exposed in a position adjacent the lower end of the right-hand wing 30 and the compressed air from the air source is fed through an air filter 77 to a pressure regulation valve 78 mounted within the wing 30 by a pipe (not shown) and regulated to a predetermined pressure in the regulation valve 78. Thereafter, the compressed air which now has a predetermined pressure value passes from the valve 78 into an oiler 79 which serves to intermix a minor amount of oil in the air. The compressed air is then passed by a pipe (not shown) through a presser foot solenoid valve 80 and a clutch operation solenoid valve 81 which are also mounted in the right-hand wing 30. These solenoid valves 80, 81 are selectively shifted in accordance with command signals from the controller 28 to selectively feed or discharge the compressed air to or from the air cylinders 64, 65 so as to selectively extend or retract the air cylinders. The admixing of oil with the compressed air facilitates a minor amount of smooth operation of the solenoid valves and air cylinders.

Figure 5:
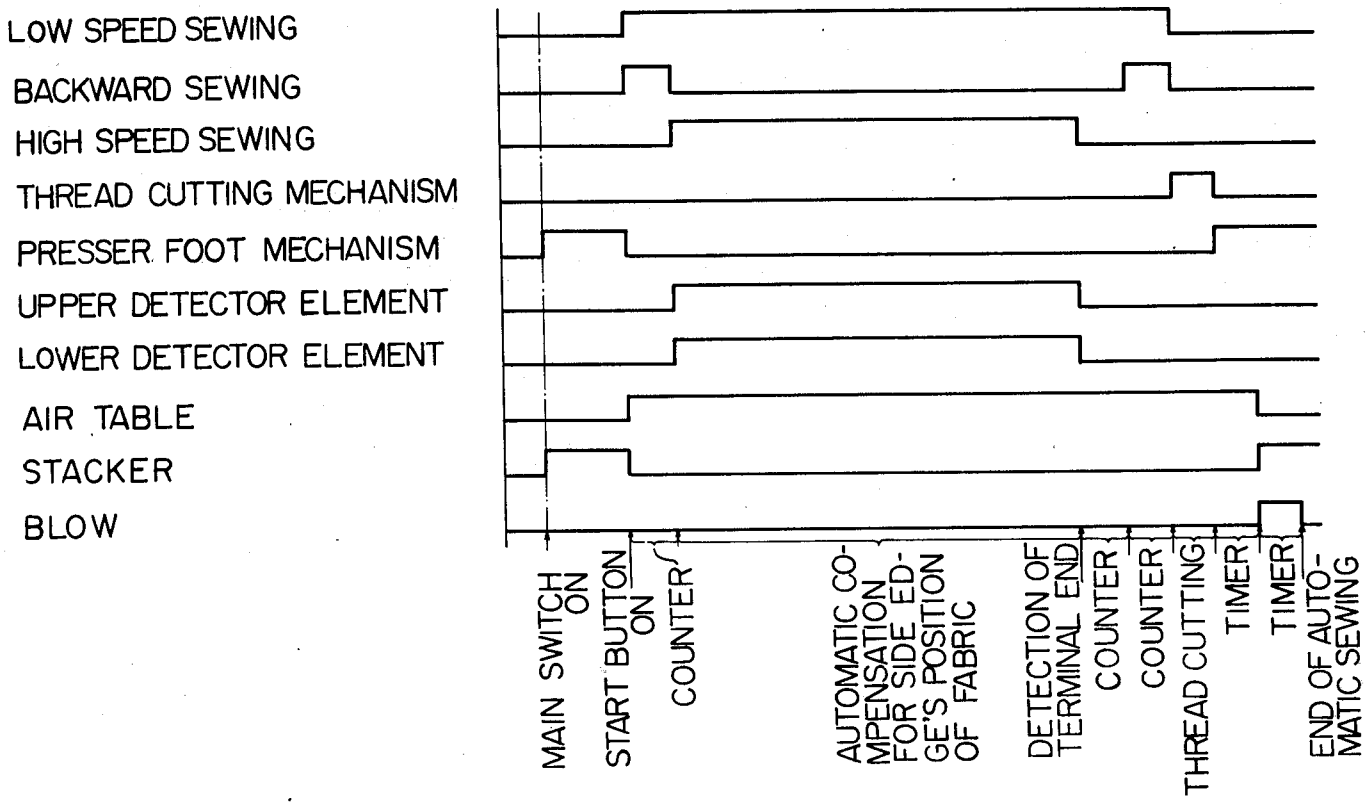
FIG. 5 is a sequence chart showing the control operation sequence in such sewing machine.

The controller 28 adapted to control the operation timing of the sewing machine mechanism 23 effects control on the driven elements of the sewing machine mechanism as shown in the sequence chart shown in FIG. 5. In operation, when the main switch 54 associated with the sewing machine mechanism 23 is thrown in, the controller 28 provides an operation command signal to the presser foot operation solenoid valve 80 to shift the valve so as to feed the compressed air to the air cylinder 64 at the inlet of the cylinder so as to retract the cylinder whereby the presser foot 39 is lifted to allow manual setting of the fabric layers and at the same time, the stacker 27 is set in motion. Thereafter, the start button 62 is depressed down to provide an operation commencement command signal to the controller 28 which in turn interrupts the passage of the signal to the solenoid valve 80 to allow the solenoid valve 80 to return to its initial position whereupon the inlet of the air cylinder 64 is opened to the atmosphere so as to lower the presser foot 39 to the fabric holding position in which the presser foot 39 holds down the fabric in cooperation with the underlying feed dog 44. Simultaneously under the command of the controller 28, an operation circuit (now shown) associated with the air table 26 is closed and in consequence, a blower is operated in the manner as will be described hereinafter and an operation circuit (not shown) associated with the stacker 27 is opened to allow the stacker to return to its initial position. In keeping pace with the above-mentioned operations, the controller 28 commands the closing of a low speed sewing switch circuit (not shown) in the control box 53 and a solenoid circuit (not shown) associated with the feed dog, clutch, respectively, and shift the feed dog clutch to the backward sewing position while providing a command signal to the auxiliary motor 48 to be rotated, whereby the feed dog 44 feeds the fabric pieces in the backward direction in cooperation with the presser foot 39 whereupon the sewing machine mechanism 23 initiates an automatic backward sewing cycle at a low speed. The number of stitches made in this backward sewing at low speed is counted by a counter (not shown) provided within the controller 28. The number of stitches to be made in the low speed backward sewing operation can be suitably and previously set by a stitch number adjusting control 83 mounted on the operation panel 82 on the front surface of the right-hand swing 30 of the base 31. When a predetermined number of stitches has been countered by the counter, the controller 28 opens the circuit associated with the feed dog clutch to shift the clutch to the forward sewing position. The shifting of the feed dog clutch to the forward sewing position provides a command signal to the solenoid valve 81 associated with the clutch to shift the valve to the forward sewing position so as to feed compressed air to the upper end of the air cylinder 65 to retract the cylinder whereupon the operation lever 51 is pulled downwardly and the connection of the clutch 49 is shifted from the auxiliary motor 48 to the main motor 47 and as a result, the sewing machine mechanism 23 now initiates a forward sewing cycle at high speed. On the other hand, when a predetermined number of stitches has been made in the backward sewing cycle at low speed or at the moment when the sewing machine mechanism initiates its forward sewing cycle at high speed, the controller 28 also provides an operation command signal to the fabric positioning device 24. Thereafter, during the high speed forward sewing cycle, the controller 28 provides no direct command signals to the fabric positioning device 24, but the device 24 serves to automatically align the free side edges of the two superposed layers of fabric.

Figure 6:
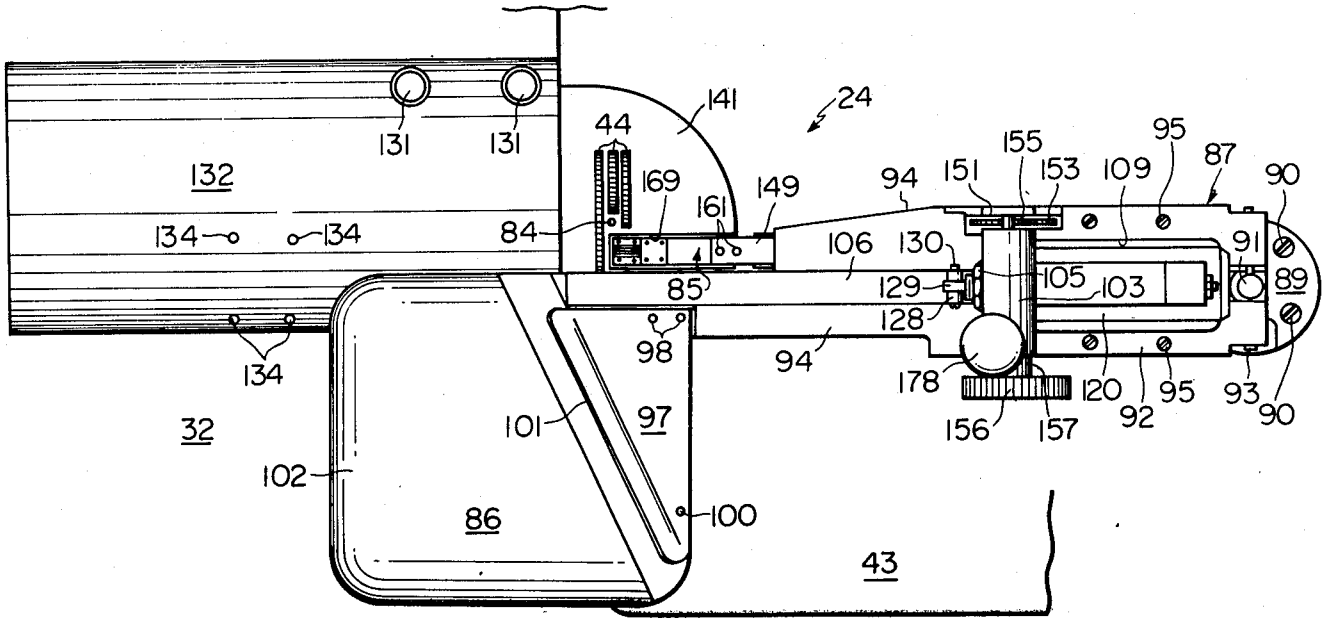
FIG. 6 is a top plan view on an enlarged scale of the fabric positioning device of such sewing machine.
Figure 7:
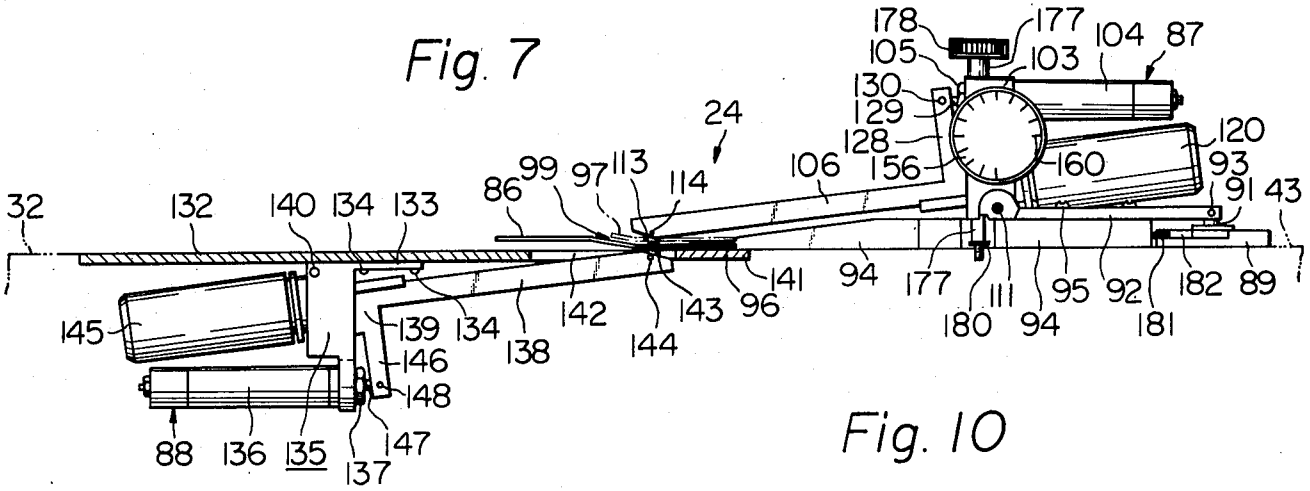
FIG. 7 is a side elevational view of FIG. 6.

For such purpose, as more clearly shown in FIGS. 6 and 7, the fabric positioning device 24 comprises an upper manipulator means 87 including a detector member 85 adapted to individually detect the edges of the two superposed layers of fabric in a position located upstream from a needle center 84 and a separator plate 86 adapted to separate the free side edges of the layers of fabric from each other and a lower manipulator means 88 cooperating with the upper manipulator means 87.

The upper manipulator means 87 has a mounting member 89 which is fixedly secured to the lower portion 43 of the sewing head 33 by means of set screws 90 so that the manipulator means 87 is positioned in a predetermined position. The mounting member 89 has a rotary shaft 91 rotatably mounted in the center of the member. The manipulator means 87 has a base member 92 of which the base end is pivotally connected to the shaft 91 by means of pins 93 so that the base member can pivot upwardly and downwardly with respect to the mounting member 89. Secured to the undersurface of the base member 92 by means of screws 95 is the base end of a supporting arm 94 which extends leftwards from the shaft 91 as seen in FIG. 7. The upper and lower surfaces of the other end of the supporting arm 94 are bevelled to reduce the thickness of the arm end as shown by 96. Disposed below and above the thinned end 96 are a separator plate 86 and a fabric presser plate 97 which embraces the thinned end of the supporting arm 94 and are secured thereto by means of a common screw 98. The separator plate 86 is formed of a square flat plate and is located upstream from the needle center 84 and extends over the table 32. The fabric presser plate 97 serves to prevent the upper layer of fabric from turning up during a sewing cycle and is formed of a triangular shaped plate parallel to the separator plate and positioned above the right-hand end of the separator plate 86 (as seen in FIG. 6) in a spaced relationship thereto as shown by 99 in FIG. 7. As shown, the fabric presser plate 97 is connected to the separator plate 96 by means of a guide pin 100. The two superposed layers of fabric are inserted into the space 99 embracing the separator plate 86 from above and below. Especially, the upper layer is inserted between the separator plate 86 and fabric presser plate 97. In this case, in order to properly and easily set the fabric layers, the separator plate 86 and presser plate 97 are rounded at the corners thereof except for a corner where the separator plate and holder plate are secured to the supporting arm 94. Further, the separator plate 86 is bent at an area facing the left-hand edge 101 of the fabric presser plate 97 (as seen in FIG. 6) to provide a ¬_-shaped configuration to the separator plate 86 as shown in FIG. 7. That is, the left-hand portion 102 of the separator plate 86 is slightly higher than the rest of the plate which extends along the fabric presser plate 97, and the left-hand portion of the fabric holder plate 97 including the left-hand edge 101 is bent upwardly.

Figure 8:
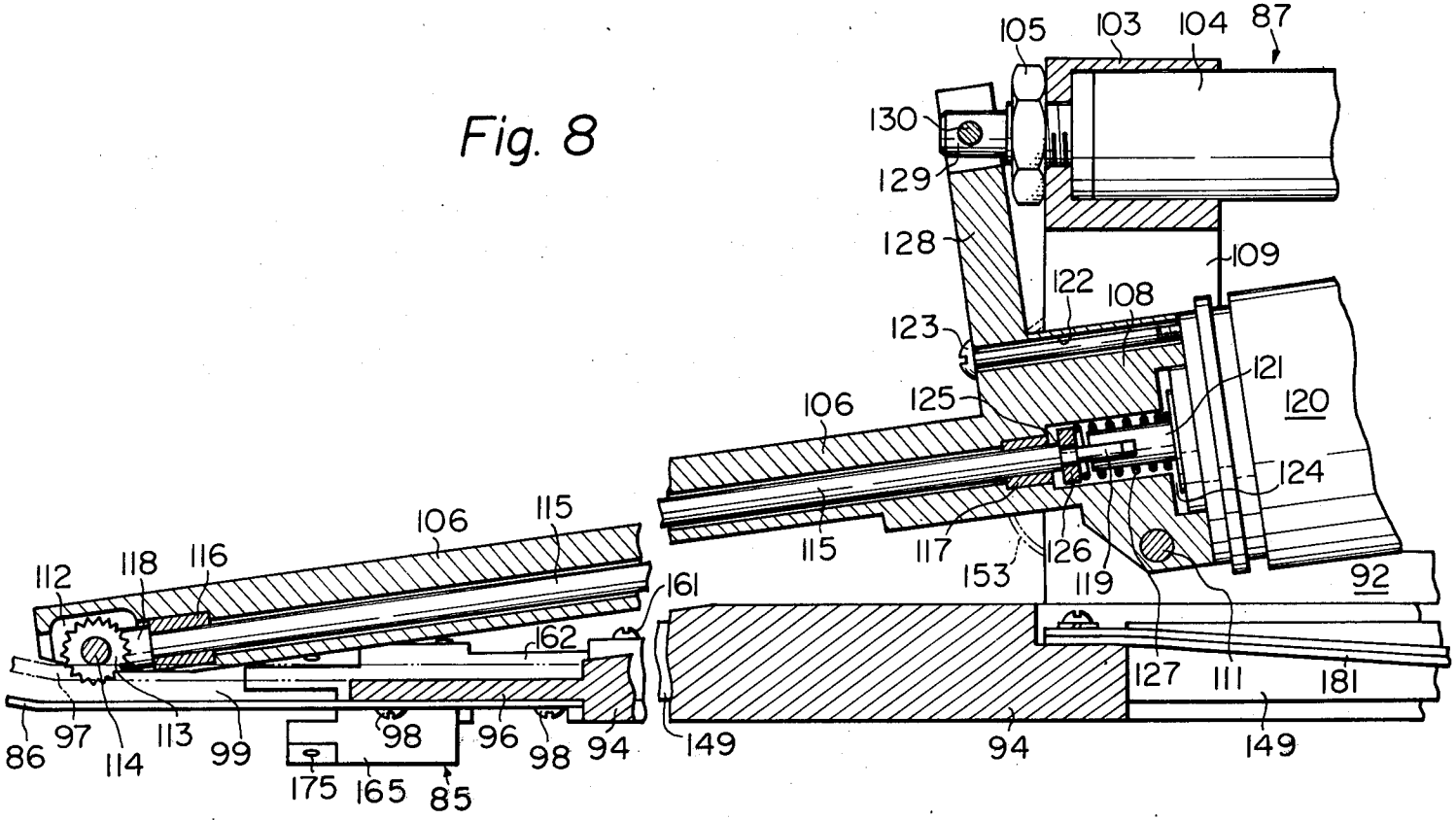
FIG. 8 is a fragmentary view on an enlarged scale in partial section of the upper manipulator means of such sewing machine.

The base member 92 includes an upwardly extending bracket 103 at the left-hand end, and the bracket 103 has an air cylinder 104 secured to the upper portion of the bracket by means of a nut 105. An arm 106 constituting an important part of the upper manipulator means 87 is provided with a supporting block 108 at the base portion as more clearly shown in FIG. 8. The supporting block 108 is received in an opening 109 formed in the base member 92 and pivotally supported on the base member 92 by means of a pivot pin 111. The arm 106 extends leftwards and downwardly from the supporting block 108 with the left end of the arm extending beyond the needle center 84 and facing the surface of the separator plate 86. The end of the arm 106 is formed with a recess 112 which opens downwardly and a pinion 113 is rotatably mounted within the recess 112 by means of a pin 114 such that the lower portion of pinion 113 projects downwardly out of the recess 112. In order to impart a rotational movement to the pinion 113, a power transmission shaft 115 extends within the arm 106 along the length of the arm and is rotatably supported by bearings 116, 117. A crown gear 118 is mounted at the left-hand end of the power transmission shaft 115 and engages the above-mentioned pinion 113. The base or right-hand end of the transmission shaft 115 is connected to a shaft 121 of an electric motor 120 by means of a tongue and groove joint 119. The left-hand portion of the electric motor 120 (as seen in FIG. 8) is fitted in the supporting block 108 of the arm 106 and secured to the base of the supporting block 108 by means of a screw 123 received in a through hole 122 formed in the supporting block 108 whereby the rotation of the electric motor 120 is transmitted to the pinion 113 through the power transmission shaft 115 and crown gear 118 to rotate the pinion 113 about the pin 114. In this case, in order to maintain the crown gear 118 and pinion 113 in proper engagement with each other, the arm 106 is formed in the base portion thereof with an axial opening 124, and the portion of the transmission shaft 115 which is received within the opening 124 is provided with a stepped portion 125 on which a thrust bearing 126 is fitted. A coiled spring 127 is disposed about the motor shaft 121 between the thrust bearing 126 and motor 120 so that the biasing force of the coiled spring 127 normally urges the transmission shaft 115 leftwards as seen in FIG. 8. A connecting arm 128 extends upwardly from the supporting block 108 and has the upper end connected, by means of a pin 130, to the piston rod 129 of the air cylinder 104 secured to the bracket 103 of the base member 92.

On the other hand, as more clearly shown in FIGS. 6 and 7, the lower manipulator means 88 is in symmetrical relationship to the upper manipulator means 87 through an opening in the table 32 by securing a base member 133 to the undersurface of a mounting plate 132 by means of screws 134, the mounting plate 132 being in turn secured to the lower portion 43 of the sewing head 33 by means of screws 131. The base member 133 includes a downwardly extending bracket 135 at the left-hand end of the base member, and an air cylinder 136 is secured to the bracket 135 by means of a nut 137. An arm 138 constituting an important part of the lower manipulator means 88 has the same construction as that of the arm 106 of the upper manipulator means 87 and is pivotably mounted on the base member 133 by means of a pivot pin 140 which pivotably supports a supporting block 139 of the arm 138. The arm 138 extends rightwards and upwardly from the supporting block 139. The upper surface of the right-hand end portion of the arm 138 is exposed through an opening 142 formed in the mounting plate 132. A pinion 143 is rotatably supported on the right-hand end of the arm 138 by means of a pin 144 and faces the pinion 114 on the upper manipulator means 87 with the separator plate 86 interposed therebetween. Although not described in detail, as in the case of the upper manipulator means 87, the pinion 143 of the lower manipulator means 88 is rotatably driven by an electric motor 145 secured to the base end of the supporting block 139. The supporting block 139 has a downwardly extending integral arm 146 which is connected to the piston rod 147 of an air cylinder 136 which is in turn secured to the bracket 135 of the base member 133.

Turning to the upper manipulator means 87 again, the upper manipulator means 87 includes a slidable holding arm 149 which slidably moves within the supporting arm 94. The holding arm 149 extends horizontally along the abovementioned arm 106 and the left-hand end of the holding arm 149 projects out of the end of the supporting arm 94. As more clearly shown in FIG. 9, the base or right-hand end of the holding arm 149 has a rack 150 secured thereto by means of screws 107. The rack 150 is in meshing engagement with a gear 153 which is positioned between a bracket 151 secured to the supporting arm 94 by means of screws 110 and the bracket 103 of the base member 92 and rotatably supported by a shaft 152. Furthermore, the gear 153 is in meshing with a pinion 155 at one end of a shaft 154 rotatably journalled in the bracket 103, and the other end of the shaft 154 has a knob 156 secured thereto whereby when the shaft 154 is rotated by manipulating the knob 156, the rotational movement of the shaft 154 is transmitted through the pinion 155 to the gear 153. As the gear 153 rotates, the rotational movement of the gear 153 is transmitted through the rack 150 to the holding arm 149 to move the holding arm back and forth. In this case, in order to regulate the movement of the holding arm 149, as shown in FIG. 6, a click mechanism 157 is disposed between the knob 156 and the bracket 103 of the base member 92, and a calibration means 160 is provided between the surface of the knob 156 and a cover 159 which is secured to the base end of the upper manipulation means 87 by means of a screw 158 and which covers the upper manipulator means 87 as seen in FIGS. 1 and 7.

Figure 10:
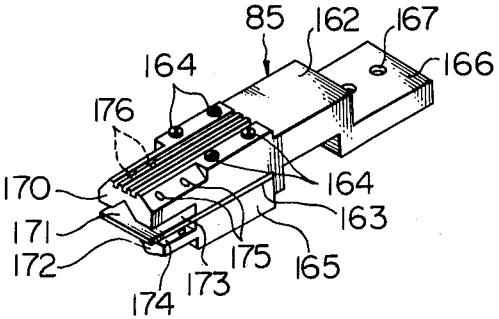
FIG. 10 is a perspective view of the detector member of said sewing machine.
Figure 11:
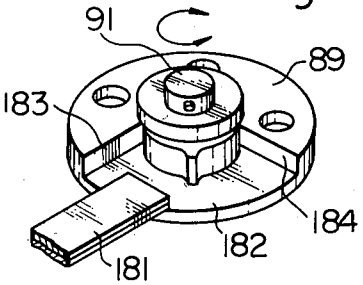
FIG. 11 is a perspective view of the mounting portion of said upper manipulator means of FIG. 8.

During the time when the sewing machine mechanism 23 is operating in a high speed forward sewing cycle, a detector member 85 detects the side edge positions of two superposed layers of fabric to be sewn together and at the completion of the forward sewing operation, the detector member detects a terminal end of the sewn fabric. The detector member 85 is mounted to the left-hand end of the holding arm 149 of the upper manipulator means 87 by means of screws 161. As shown in FIG. 10, the detector member 85 is formed by an upper holder 162 and a lower holder 165 with a reflective plate 163 interposed therebetween, and these parts of the detector member 85 are secured together by means of screws 164. The upper holder 162 has a mounting hole 167 at the base or right-hand end 166 thereof for receiving a screw 161 to secure the upper holder 162 to the end of the holding arm 149 of the upper manipulator means 87, whereby the detector member 85 is disposed at a predetermined position upstream from the needle center 84 in the sewing head 33, as shown in FIG. 6. With the detector member 85 positioned in this position, the lower holder 165 is set in a notch 169 in the throat plate 141 on the sewing head 33. Turning now to FIG. 10, an end portion 170 of the upper holder 162 and the corresponding end portion 171 of the reflective plate 163 extend beyond an adjacent end portion 172 of the lower holder 165. Suitable spaces 173 and 174 are provided between the end portion 170 of the upper holder 162 and reflective plate 163 and between the end portion 172 of the lower holder 165 and reflective plate 163, respectively, each space having a specific height. The end portion 170 of the upper holder 162 is formed substantially V-shaped with the apex directed upwardly. Similarly, the end portion 172 of the lower holder 165 is also formed substantially V-shaped with the apex directed downwardly. Luminous diodes 175 and photo transistors 176 in two pairs as detector elements are provided in the end portion 170 of the upper holder 162 and exposed to the undersurface of the holder end portion, and one pair of luminous diode and a photo transistor 175, 176 are provided in the end portion 172 of the lower holder 166 and are exposed to the upper surface of the lower holder surface. One pair of a luminous diode and a photo transistor 175, 176 in the tip end of the upper holder 162 serve to detect the terminal end of the sewn fabric, and the other pairs of luminous diodes and photo transistors 175, 176 in the upper and lower holder end portions 170, 172 serve to detect the free side edges of the layers of fabric. The upper layer of the superposed layers of fabric is passed through the space 173 between the upper holder 162 and reflective plate 163 and set therein, and the lower layer is passed through the space 174 between the lower holder 165 and reflective plate 163 and set therein. Thus, when each fabric layer completely covers the associated pair of a luminous diode and a photo transistor 175, 176, since only some of the rays emitted from the luminous diode 175 and reflected by the fabric surface reach the associated photo transistor 176 and are received thereby, the current controlled by the photo transistor 176 becomes small. On the other hand, when the fabric layer does not cover the luminous diode and photo transistor 175, 176, almost all of the light rays emitted from the luminous diode 175 are reflected by the reflective plate 163 onto the photo transistor 176 to be received thereby. Thus, the current controlled by the photo transistor 176 becomes great. In this way, the detector elements constituted by the luminous diode 175 and photo transistor 176 detect the positions of the free side edges and terminal end of the fabric as current values controlled by the photo transistor 176.

Figure 9:
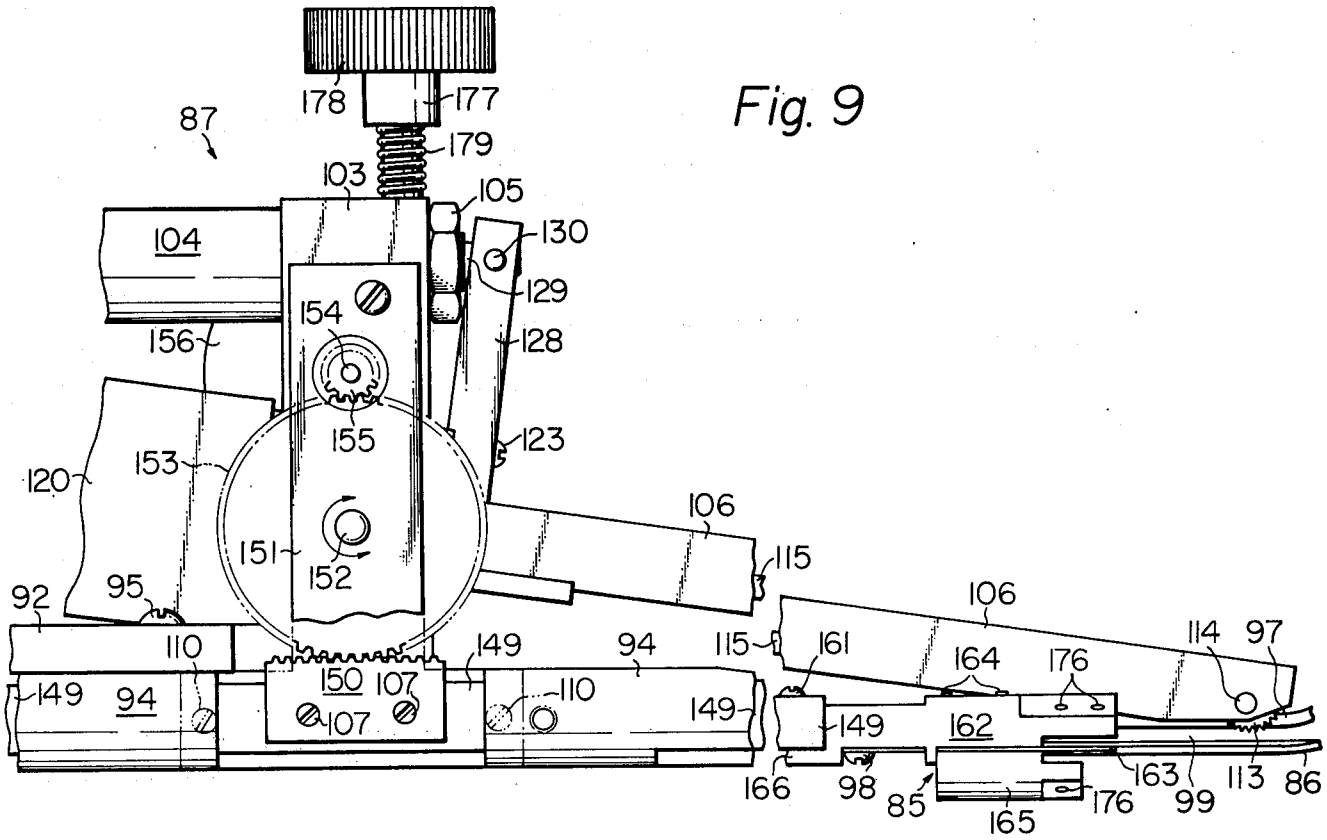
FIG. 9 is a rear view of the upper manipulator means of FIG. 8 with a portion thereof broken away.

As clear from FIGS. 7 and 9, the upper manipulator means 87 includes a slidable setting rod 177 which extends vertically through the bracket 103. The setting rod 177 has a knurled knob 178 at the upper end thereof, and a coiled spring 179 is disposed about the setting rod 177 between the knob 178 and bracket 103. Thus, the biasing force of the coiled spring 179 normally urges the setting rod 177 upwardly, and a snap ring 180 mounted on the rod at the lower end thereof abuts against the undersurface of the base member 92. The base end or right-hand end of the supporting arm 94 has a leaf spring 181 secured thereto and the other end of the leaf spring 181 extends into a notch 182 in the upper surface of the mounting member 89 to apply a force on the surface. The biasing force of the leaf spring 181 urges the mounting member 92 and supporting arm 94 upwardly and in an inclined direction with respect to the mounting member 89 about the pin 93. Under the upward biasing force of the leaf spring 181, the detector member 85 slips out of the notch 169 in the throat plate 141. Thus, the upper manipulator means 87 can rotate between an operative position in which the leaf spring 181 abuts against one end 183 of the notch 182 in the mounting member 89 and an inoperative position in which the leaf spring 181 abuts against the other end 184 of the notch 182. In this way, the upper manipulator means can be held in the inoperative position so as not to interfere with the sewing operation. During the automatic sewing operation, the upper manipulator means 87 is brought to the operative position and the knob 178 is then depressed down and turned whereupon the lower end of the setting rod 177 is screwed into a threaded hole (not shown) in the lower portion 43 of the sewing head 33 to set the upper manipulator means in a predetermined position.

Compressed air for operating the upper and lower manipulator means 87, 88 is supplied from the oiler 79 shown in FIG. 2 by a pipe (not shown) through pressure regulation valves 185, 186 to solenoid valves 187, 188 for the upper and lower manipulator means 87, 88. The pressure regulation valves 185, 186 are attached to the rear side of the right-hand wing 30 of the sewing machine mechanism 23 and adjusting knobs 189, 190 project outwardly from the front surface of the operation panel 82. By manipulating the knobs 189, 190, the pressure of compresed air supplied to the air cylinder 104 associated with the upper manipulator means 87 and the pressure of compressed air supplied to the lower manipulator means 88 can be individually regulated. The adjusted pressures are indicated in pressure gauges 191, 192 mounted on the front surface of the operation panel 82, which gauges are associated with the knobs 189, 190, respectively. The solenoid valves 187, 188 effect a shifting operation in accordance with command signals from the controller 28 to feed compressed air to the air cylinders 104, 136 and discharge the compressed air from the air cylinders 104, 136, to extend and retract the air cylinders to thereby rock the arms 106, 138 about the pivots 111, 140, respectively.

On the other hand, the air cylinders 104, 136 are normally held in their retracted position by the biasing force of springs (not shown) mounted in the cylinders so that the pinions 113, 143 associated with the arms 106, 138, respectively, are held in their relative position away from the separator plate 86 as shown in FIG. 7. With the air cylinders and pinions held in the position as mentioned above, the two superposed layers of fabric to be sewn together are previously set between the upper and lower pinions 113, 143 with the separator plate 86 embraced by the fabric pieces. However, when the solenoids 187, 188 are operated to shift in response to signals from the controller 28, compressed air is supplied at the base ends of the air cylinders 104, 136 whereupon the cylinders extend to cause the arms 106, 138 to pivot to thereby urge the pinions 113, 143 against the separator plate 86 whereby the two superposed layers of fabric are pinched between the pinion 113 and separator plate 86 and between the pinion 143 and separator plate, respectively. The electric motors 120, 145 for driving the pinions 113, 143, respectively, receive command signals through the controller 28 as the current value varies under the control of the fabric side edge detection photo transistor 176 in the detector member 85. The motors 120, 145 are reversible motors and rotate in response to such signals to compensate for a variation in current value while shifting the fabric layer or layers leftwards or rightwards through the pinions 113, 143.

The controller 28, solenoid valves 187, 188 and detector member 85 have the following relationship to each other. When the number of backward stitches at low speed has reached a predetermined count value and the sewing machine mechanism 23 is switched to a forward sewing operation at high speed in response to signals from the controller 28, simultaneously the controller 28 provides operation signals to the solenoid valves 187, 188 and closes the operation circuit for the detector member 85. As seen from the sequence chart in FIG. 5, as soon as the sewing machine mechanism 23 initiates its forward sewing at high speed, the upper and lower fabric side edge detector elements in the detector member 85 detect the positions of the free side edges of the fabric layers as variations in current value. By employing the variation in current value as an input signal, the controller 28 rotates the electric motors 120, 145 associated with the upper and lower manipulator means 87, 88, respectively, either in the forward or reverse direction to thereby cause the pinions 113, 143 to feed the fabric layer or layers leftwards or rightwards so that the free side edges of the fabric layers can always be aligned properly. In this way, a sewing operation cycle can be automatically performed while maintaining a constant margin for sewing on the fabric layers. It will be understood that the width of margin for sewing can be easily varied by moving the detector member 85 through the manipulation of the knob 156 associated with the upper manipulator means 87.

During a sewing cycle, the two superposed layers of fabric are fed in a predetermined direction as the feed dog 44 moves while being held against the feed dog 44 by the holding-down force of the presser foot 39 and therefore, although the lower layer is directly subjected to the movement of the feed dog 44, the upper layer is only indirectly subjected to the movement of the feed dog 44 through the lower fabric piece. As a result, the upper layer tends to lag behind the lower layer and this tendency is quite apparent if the lower fabric piece is of slippery material. In order to eliminate this difficulty, in the operation of conventional sewing machines, it has been practiced that the operator maintains the free side edges of the fabric layers in alignment by his right hand and simultaneously places his left hand on the successive sewn portions of the fabric layers to pull them in the feed direction by the feed dog 44 to thereby eliminate the lagging of the upper fabric piece. However, in the automatic sewing machine of the present invention which eliminates such troublesome manual work, specific means for eliminating the lagging of the upper layer behind the lower fabric piece is provided. With respect to this point, as mentioned hereinabove, the separate pressure regulations valves 185, 186 are provided for supplying compressed air from a source to the air cylinders 104, 136 associated with the upper and lower manipulator means 87, 88, respectively, so that the lagging of the upper layer can but substantially eliminated. The reason is that by manipulating the regulation knobs 189, 190 associated with the pressure regulation valves 185, 186, respectively, the pressure of compressed air to be supplied to the air cylinders 104, 136 of the upper and lower manipulator means 87, 88 is separately regulated so that the pinching pressure applied to the respective fabric layer by the pinions 113, 143 can be freely varied to thereby individually regulate the amount of feeding of each of the fabric layers. With this arrangement, the pressure of compressed air to be supplied to each of the air cylinders 104, 136 can be regulated depending upon the thickness, material, smoothness and/or elongation of the fabric layers, whereby both the upper and lower layers can be simultaneously fed at the same speed, and if necessary, upper and lower layers of different lengths can be sewn with the free side edges maintained in alignment while pulling one of the fabric layers.

Furthermore, during the automatic sewing operation referred to hereinabove, as the fabric layers are fed in a predetermined direction by the feed means in the sewing machine mechanism, the fabric layers are subjected to a rotational moment in the counter-clockwise direction as mentioned hereinabove due to their size or sizes and gravity, and such rotational moment frequently causes deterioration of the ability of the upper and lower manipulator means 87, 88 to control the fabric tree side edges. Therefore, as shown in FIGS. 1 through 3, in order to eliminate such rotational moment acting on the fabric pieces, the auxiliary guide 25 and air table 26 are provided in association with the front edge and upper surface of the table 32 in the sewing machine mechanism 23, respectively.

Figure 12:
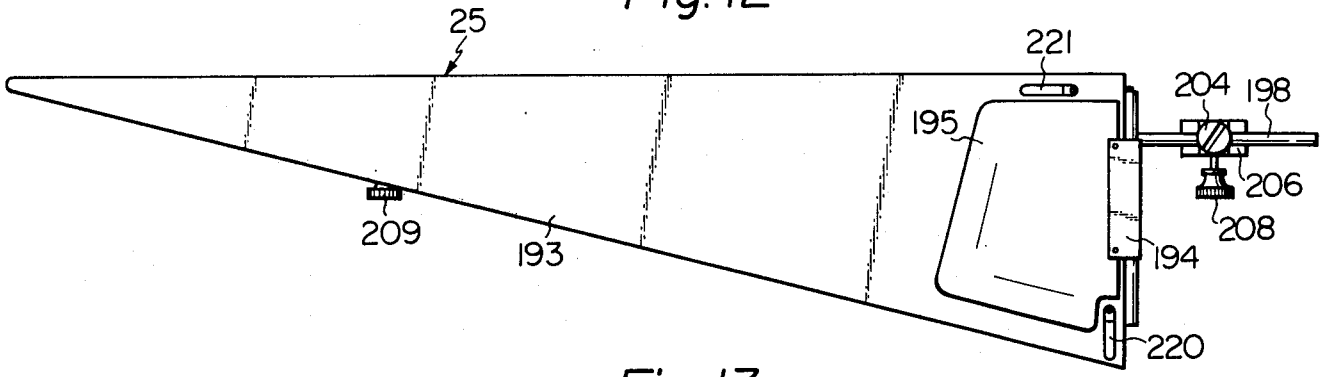
FIG. 12 is a front elevational view of the auxiliary guide of the sewing machine.
Figure 13:
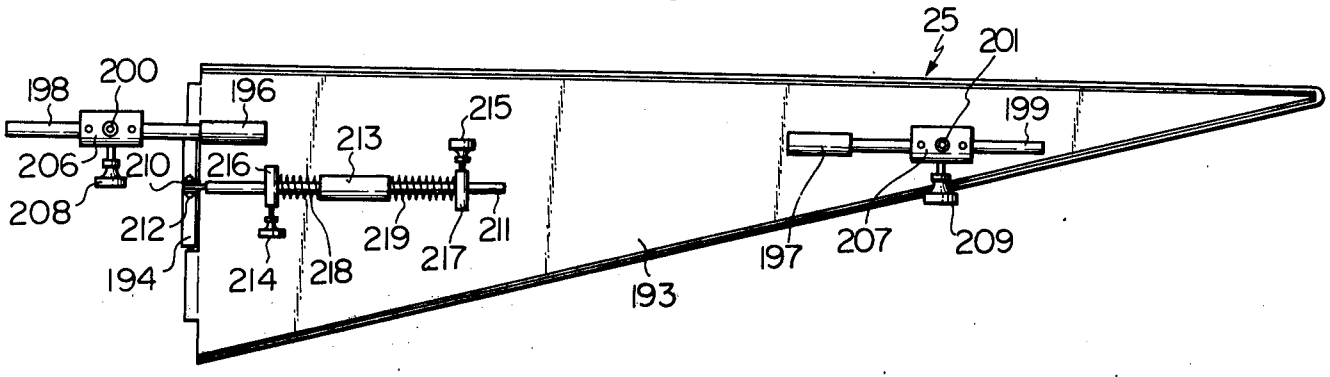
FIG. 13 is a rear view of the auxiliary guide of FIG. 12.
Figure 14:
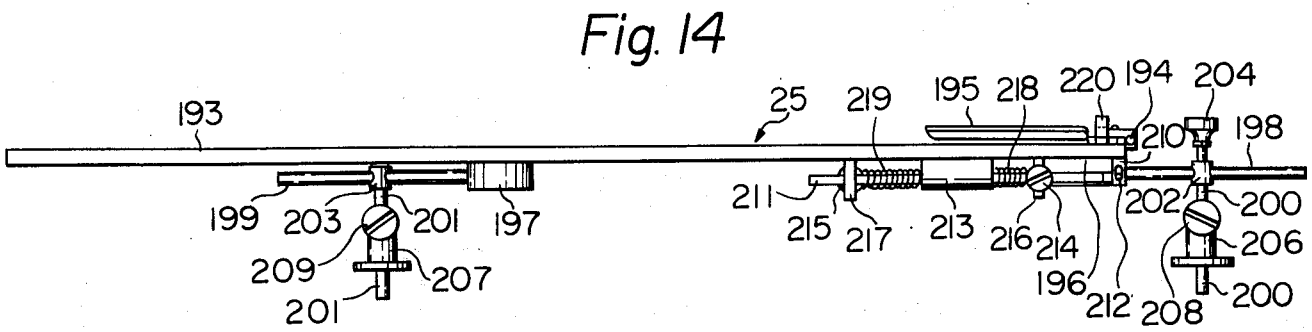
FIG. 14 is a bottom view of the auxiliary guide of FIG. 12.

As more clearly shown in FIGS. 12 through 14, the auxiliary guide 25 comprises a right-angled guide plate 193 rounded at the upper and lower edges thereof, and a pressure plate 195 hinged at 194 to the right-hand edge of the guide plate 193. The guide plate 193 includes first guide rods 198, 199 secured to the reverse surface by means of blocks 196, 197, respectively, and second guide rods 200, 201 are slidably and rotatably mounted on the first guide rods 198, 199 by means of guide members 202, 203 mounted at one end of the respective second guide rods. The first guide rods 198, 199 extend horizontally along the reverse surface of the guide plate 193, and the second guide rods 200, 201 extend from the first guide rods 198, 199 at right angles thereto, respectively. A lock screw 204 is screwed in the front side of the guide member 202 on the second guide rod 200, and by tightening the lock screw 204, the second guide rod 200 is secured to the first guide rod 198. The second guide rods 200, 201 are slidably received in guide blocks 206, 207 secured to a beam 205 (see FIG. 1) extending in the upper portion of the base 31 in the sewing machine mechanism 23, and the second guide rods 200, 201 are set in a desired position by tightening lock screws 208, 209 screwed in the undersurfaces of the guide blocks 206, 207, respectively. Thus, the guide plate 193 is positioned in a position facing the front side edge of the table 32 in the sewing machine mechanism 23 and normally held in its retracted or stowage position as shown in FIGS. 1 through 3. During an automatic sewing cycle, the guide plate 193 will be extended along the guide blocks 206, 207 to a desired position by manipulating the lock screws 208, 209 and then adjusted to a suitable position in the longitudinal direction along the front side edge of the table and at a suitable angle with respect to the table surface by manipulating the lock screw 204. The pressure plate 195 hinged at 194 to the right-hand end of the guide plate 193 includes a connector arm 210 depending from the base end of the guide plate. A horizontal rod 211 is hinged to the front end of the connector arm 210 by means of a pin 212. The rod 211 extends through and leftwards from a guide 213 which is in turn secured to the reverse side of the guide plate 193. Coiled springs 218, 219 are disposed about the rod 211 between the opposite ends of the guide 213 and spring abutment members 216, 217 which are in turn secured to the rod 211 by means of lock screws 214, 215, respectively, and the difference in biasing forces between the springs 218, 219 urges the pressure plate 195 against the front side of the guide plate 193. Adjustment pieces 220, 221 are secured to the front side of the guide plate 193 above and below the pressure plate 195 to prevent any excessive rightward displacement of fabric pieces. Thus, during a sewing cycle, the right-side edges of the superposed fabric layers are received between the guide plate and pressure plate 195. As the fabric layers are fed in a predetermined direction by the feed means in the sewing machine mechanism 23, the pressure plate 195 biases the portions of the fabric layers against the guide plate 195 so as to impart resistance to the fabric layer portions. And the fabric layers are guided leftwards along the sloped front side edge of the guide plate 193 so as to be subjected to a rotational moment in the clockwise direction so that the counter-clockwise rotational moment applied to the fabric layers by the feed means in the sewing machine mechanism 23 is counteracted.

As more clearly shown in FIGS. 1 and 3, the air table 26 is positioned in the left-hand portion of the table 32 in the sewing machine mechanism 23. A recess 222 is formed in the upper surface of the table 32 in the left-hand side portion of the table and a porous plate 225 is secured to the table 32 over the recess 222 by means of screws 226. The porous plate 225 has a great number of through air holes 223 slanting forwardly and a great number of through air holes 224 slanting leftwards. The bottom of the recess 222 is also provided with a suitable number of openings 227 which communicate with a duct 228 secured to the undersurface of the table 32 and a blower 229 is provided in communication with the duct 228. Thus, during a sewing cycle, when a rotation command signal is provided to the blower 229 through the controller 28, air is blown through the holes 223, 224 in forwardly and leftwardly slanted directions. These air flows reduce friction generated between the lower fabric piece and the table and also smooth the feeding of the fabric layers. Simultaneously, the air flows impart forces directed in the leftward and rearward directions to the fabric layers and reduce the counter-clockwise rotational moment applied to the fabric pieces in the same manner as does the auxiliary guide.

Thus, during a sewing cycle, the auxiliary guide 25 and air table 26 cooperate with each other in uniformly feeding the fabric layers in a proper disposition as the feed means in the sewing machine mechanism 23 operates, and as mentioned hereinabove, positive control on the fabric layers side edge position by the upper and lower manipulator means 87, 88 can be assured.

As is clear from the foregoing description, according to the present invention, during a forward sewing cycle at high speed, the upper and lower manipulator means 87, 88 automatically control the free side edge position of the two superposed fabric layers in response to command signals from the detector member 85, and the sewing cycle can be performed with the free side edges of the fabric layers in proper alignment. As the sewing cycle draws to termination, when the terminal end of the sewn fabric passes by the detector elements at the tip portion of the upper holder member 162 in the detector member 85, which detector elements have previously been covered by the fabric layers, the detector member 85 senses the terminal ends of the fabric layers and provides a signal to the controller 28. In response to this signal, the controller 28 opens the operation circuit for the detector member and terminates the supply of operation signals to the solenoid valves 187, 188 so as to retract the air cylinders 104, 136 of the upper and lower manipulator means 187, 188 to thereby return the arms 106, 138 to their initial positions in which the fabric layers are released from the pinching pressure applied thereto. Simultaneously, the controller 28 interrupts the supply of the operation command signal to the solenoid valve 81 to return the air cylinder 65 to its initial position and releases the operation lever 51 so as to shift the connection of the clutch 49 from the main motor 47 to the auxiliary motor 48 whereupon the sewing machine automatically shifts to a low speed forward sewing mode. The number of stitches in this low speed forward sewing cycle is counted by the counter in the controller 28 and when a predetermined number of stitches has been counted, the controller 28 closes the solenoid circuit associated with the feed dog clutch to shift the clutch to the backward sewing position whereupon the sewing machine automatically shifts its operation mode to the low speed backward sewing mode. The number of stitches in the low speed backward sewing cycle is also counted by the counter in the controller 28 and when a predetermined number of stitches has been counted, the controller 28 opens the low speed backward sewing switch circuit and closes the thread cutting switch circuit in the control box 53. Thereafter, the control box 53 cooperates with the slip ring 61 in cutting the thread during the rising stroke of the sewing needle 38 while controlling the rotational movement of the auxiliary motor 48 and the movement of the thread cutting mechanism 40 and then stops the auxiliary motor 48 at the moment when the sewing needle 38 has reached its uppermost position. On the other hand, the controller 28 receives an operation termination signal from the control box 53 to provide an operation command signal to the solenoid valve 80 which in turn shifts to the position in which the air cylinder 64 is retracted to lift the presser foot 39 to permit the removal of the sewn fabric product from the sewing zone. Thus, the fabric product begins to move forwards again under the force of air flowing through the air table 26.

Figure 16:
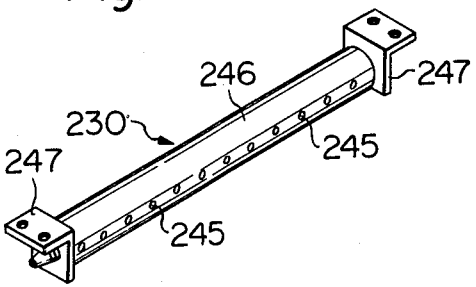
FIG. 16 is a perspective view of the blow of the stacker.
Figure 15:
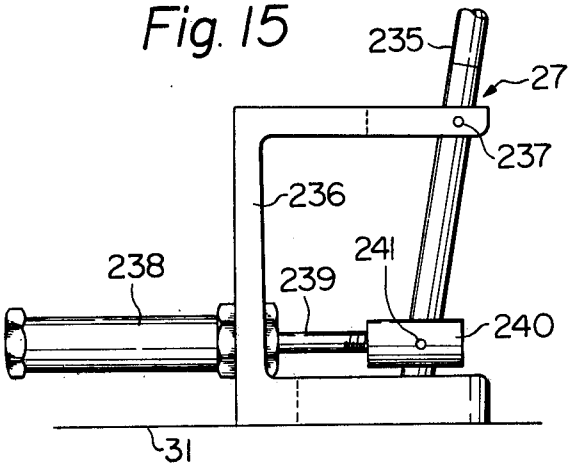
FIG. 15 is a side elevational view of the gripping bar support portion in the stacker of the sewing machine.

Thereafter, the successive sewn fabric products are removed from the sewing zone and stacked one upon another at a suitable place. For this purpose, a stacker 27 and a blower 230 are suitably mounted on the sewing machine of the present invention. As shown in FIGS. 1 through 3, the stacker 27 comprises a pair of left and right support arms 231, 232 secured to the base 31 on the rear side of the sewing machine mechanism 23, two parallel support bars 233, 234 extending horizontally between the support arms 231, 232 and a gripping bar 235 positioned between and extending parallel to the support arms 231, 232 and rockably mounted on the base 31 adjacent the lower end of the base. As more clearly, shown in FIG. 15, the gripping bar 235 is rockably mounted by means of pivot pin 237 on the upper arm of a supporting block 236 secured to the lower portion of the base 31. The supporting block 236 has an air cylinder 238 secured thereto and a piston rod 239 extends through the cylinder 238. The end of the piston rod 239 is hinged to the lower end of the gripping bar 235 through a connector 240 by means of a pin 241. The gripping bar 235 is normally biased to its standing-by or inoperative position under the biasing force of a spring (not shown) mounted within the air cylinder 238. When the air cylinder 238 is retracted by supplying compressed air to the front end or right-hand end thereof, the gripping bar 235 pivots about the pin 237 to urge non-skid members 243 mounted on an arm portion 242 at the free end of the bar 235 against non-skid members 244 mounted on the support bar 233. And as seen in FIG. 16, the blower 230 comprises a pipe member 246 having a number of air nozzles 245 and is secured to the upper portion of the rear side of the base 31 as seen in FIG. 2. The air cylinder 238 is supplied with compressed air which has passed through the oiler 79, and the blower 230 is supplied with compressed air from the same side of the oiler 79 through the solenoid valves 248, 249 by a pipe (not shown).

The operation of the stacker and the control operation of the controller will now be described. When a presser foot lifting signal is provided by the controller 28, simultaneously, a timer (not shown) mounted within the controller initiates its operation. The set time of this timer can be adjusted by an adjusting knob 250 mounted on the operation panel 82 depending upon the length of the fabric layers to be sewn together. When the holding-down force on the fabric layers by the presser foot 39 is removed from the fabric layers and the fabric is fed rapidly forwards to a predetermined position by the air table 26, that is, when the time set by the timer has elapsed, the operation circuit associated with the blower 229 in the air table 26 is broken and the solenoid valves 248, 249 are energized. Thus, the air cylinder 238 is retracted to pivot the gripping bar 235 about the pin 237. During the pivotal movement of the gripping bar 235, the non-skid members 243 on the arm 242 of the bar 235 push the fabric layers in substantially the center of the length of the fabric layers to grip them in cooperation with the non-skid members 244 on the support bar 233. Simultaneously, compressed air is blown out of the air nozzles 245 of the blower 230 to blow the trailing half portion of the length of the sewn fabric layers to the opposite side of the support bar 234 to hang them over the supporting bars 233, 234 of the stacker 27. Thereafter, the solenoid valve 249 associated with the blower 230 returns to its initial position after a predetermined time period set by another timer has passed and interrupts the ejecting of the compressed air from the blower 230, whereupon the entire sewing machine returns to its initial position.

As seen from the foregoing description, in the automatic sewing machine of the invention, after the superposed fabric pieces have been set in a predetermined or desired position, it is only necessary to push the start button 62 to set the sewing machine in motion and upon the pushing-down of the start button, a sewing operation can automatically proceed along a predetermined seam line by the cooperative action of the fabric layer positioning device 24, auxiliary guide 25 and air table 26 while maintaining the free side edges of the fabric layers in precise alignment with each other. Furthermore, the successive sewn products are stacked on the stacker one upon another. The gripping bar 235 of the stacker 27 returns to its initial position upon the pushing-down of the start button 62 or breaking of the main switch 54 as seen from the sequence chart of FIG. 5 and therefore, during the time interval required for the gripping bar 235 to return to its initial position, the sewn products stacked on the stacker 27 can be taken off the stacker to be transported to a predetermined location.

Although the embodiment of the automatic sewing machine of the invention has been described in connection with an instance in which the machine is employed as an industrial sewing machine having backward sewing means, the present invention can be equally applied to an instance in which the sewing machine has no such backward sewing means. In the latter instance, it can be easily understood that the control means associated with the backward sewing means is eliminated.

Reference will now be made to FIGS. 17 through 21 in which another embodiment of the fabric positioning device of the invention is shown. The fabric positioning device 324 consists of an upper manipulator means 375 and a lower manipulator means 376. The upper manipulator means 375 comprises a cover member 378 having a fabric layer position control mechanism 377 therein and a mounting member 379 which is mounted at the base end of the cover member 378. The mounting member 379 includes a base member 380, a rotary shaft 381 rotatably mounted in the center of the base member 380 and a mounting seat 383 pivotally mounted on the upper portion of the rotary shaft 381 by means of a pivot pin 382. The mounting member 379 is positioned on the lower portion 344 of the sewing head in a predetermined position with respect to the needle center by securing the base member 380 to the lower portion 344 of the sewing head by means of a screw 384. On the other hand, the cover member 378 is detachably attached to the mounting seat 383 of the mounting member 379 at the lower portion of the base end thereof by means of a screw 385. The cover member 378 is vertically rockable about the pin 382 through the mounting seat 383 and also pivotal about the center portion of the base member 380 by means of the rotary shaft 381.

The mounting seat 383 in the mounting member 379 includes left and right-hand vertical plates **383*a*, 383*b* for carrying the cover member 378 and a horizontal plate 383*c* connecting between the bases of the plates 383*a*, 383*b*. The mounting seat 383 is mounted for vertical rocking movement with respect to the upper portion of the rotary shaft 381 as mentioned hereinabove by mounting substantially the center of the plates 383*a*, 383*b* on the rotary shaft 381 by means of a pivot pin 382. Springs 386 are mounted on the opposite ends of the pivot pin 382 which mounts the mounting seat 383 on the rotary shaft 381 and first ends 386*a* of the springs 386 abut against the surface of the base member 380 and the other ends 386*b* of the springs 386 abut against the upper surface of the horizontal plate 383*c*. Thus, the biasing force of the springs 386 urges the mounting seat 383 and the cover member 378 upwardly and in an inclined manner about the pivot pin 382. On the other hand, the base member 380 in the mounting member 379 has a ball 387 and a spring 388 which urges the ball against the rotary shaft 381 and the surface of the rotary shaft 381 is formed with two spaced recesses 389 adapted to selectively engage the ball 387. In each of the positions in which the recesses 389 engage the ball 387 as the rotary shaft 381 rotates, a click occurs between the mounting seat 380 and rotary shaft 381**.

The cover member 378 includes an integral guide portion **378*a* and a setting rod 390 is vertically and slidably received within the guide portion 378*a*. The setting rod 390 has a knob 391 at the upper end, thereof, and a coiled spring 392 is disposed about the rod 390 between the knob 391 and cover member 378. The biasing force of the spring 392 normally urges the rod 390 towards its upper position with a snap ring 393 at the lower end of the rod 390 abutting against the undersurface of the guide portion 378*a*. The cover member 378 can rotate between an operative position in which one of the recesses 389 in the rotary shaft 381 of the mounting member 379 engages the ball 387 and an inoperative position in which the other recess 389 engages the ball 387. During a manual sewing operation, the cover member 378 having the fabric layer positioning mechanism 377 can be held in the inoperative position, and during an automatic sewing operation the cover member 378 is returned to the operative position and the knob 391 is depressed downwardly. Thereafter, the knob 391 is turned to screw the threaded lower portion 390*a* of the rod 390 into the threaded hole 394 in the lower portion 344 of the sewing head to thereby push the cover member 378 downwardly against the force of the springs 386** and set it at a predetermined position.

The cover member 378 includes a holder plate 395 slidably received in the front end of the cover member. The holder plate 395 extends through grooves 396 formed in inner projections **378*b*, 378*c* which are integrally formed with the cover member 378, with the front end of the holder plate projecting out of the front end of the cover member 378**.

Figure 17:
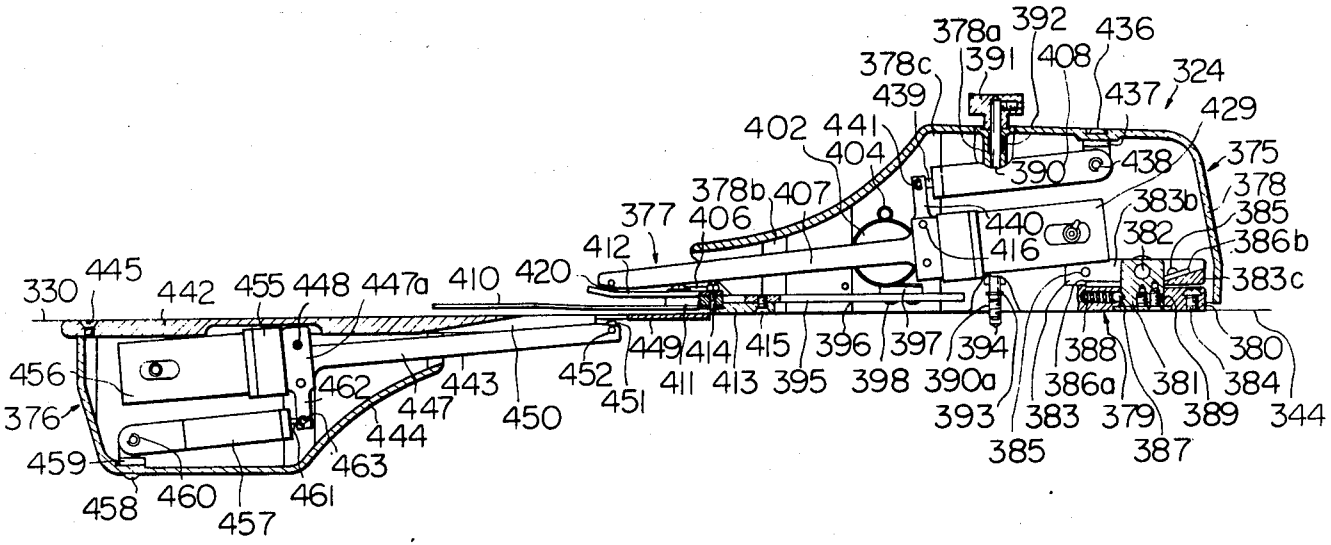
Figure 18:
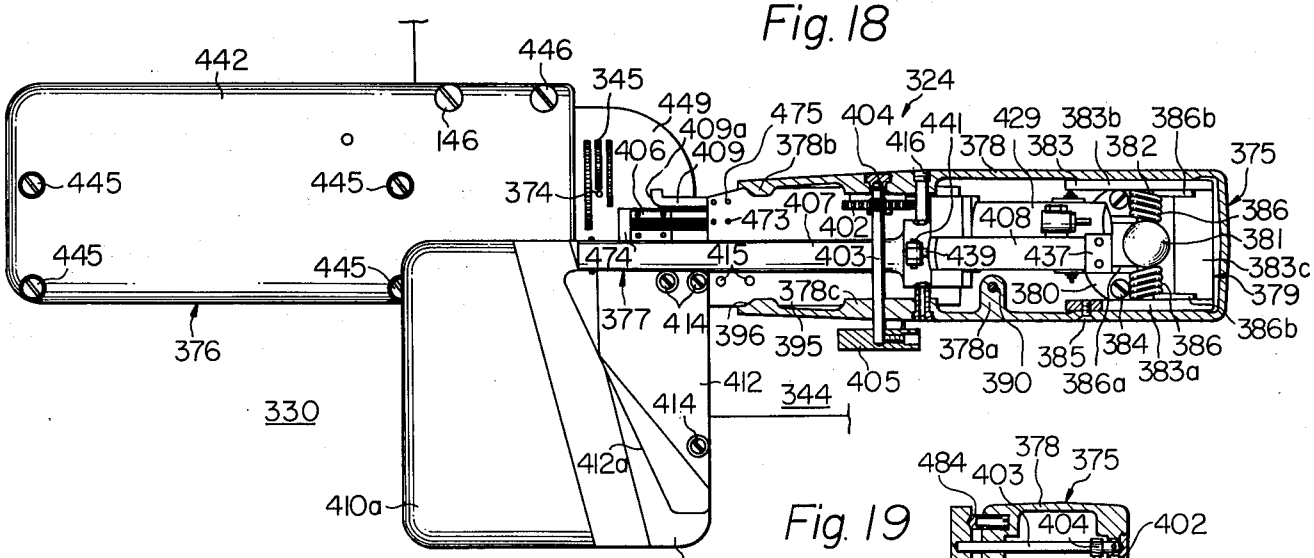
Figure 19:
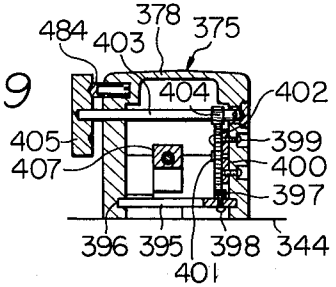

As seen from FIGS. 17 through 19, the base end of the holder plate 395 has a rack 397 secured thereto by screws 398, and the rack 397 meshes with a gear 402 rotatably mounted on a shaft 401 which is in turn journalled in a bracket 400 secured to the cover member 378 by means of a screw 399. Furthermore, the gear 402 meshes with a pinion 404 at one end of a shaft 403 journalled in and projecting out of the cover member 378, whereas the other or projecting end of the shaft 403 has a knob 405. Thus, by rotating the shaft 403 through the manipulation of the knob 405, the rotational movement of the shaft 403 is transmitted to the gear 402 through the pinion 404 so that the gear 402 moves the holder plate 395 back and forth with respect to the cover member 378 through the rack 397. The fabric layer positioning mechanism 377 in the cover member 378 comprises a detector member 406 adapted to detect the free side edges of fabric layers to be sewn and the terminal end of the sewn fabric at a position located upstream from the needle center 374 in the fabric feed direction, an arm 407 adapted to correct any deviation in the free side edge position in response to signals representing side edge position deviations detected by the detector member 406, an air cylinder 408 adapted to rock the arm 407, a positioning piece 409 adapted to assist in setting the fabric pieces in proper position and a separator plate 410 adapted to separate the two fabric layers from each other.

As shown in FIG. 20, the separator plate 410 includes a spacer piece 411 mounted on the upper surface of the separator plate at the base end thereof, a fabric presser plate 412 and a mounting plate 413 mounted on the undersurface of the separator plate at the base end thereof, and these elements of the separator plate are secured together to form a unitary structure by means of screws 414. The unitary separator plate 410 is secured to the holder plate 395 through the attachment piece 413*a* on the mounting plate 413 by means of screws 415 as shown in FIGS. 17 and 18. The separator plate 410 is formed of a square flat plate and disposed upstream the needle center 374 and extends along the upper surface of the table 330. The fabric presser plate 412 is formed of a triangular flat plate and serves to prevent the upper fabric layer from turning up during a sewing cycle. The presser plate 412 extends over and in parallel to the separator plate 410 at the base end of the separator plate in a spaced relationship to the separator plate. The two superposed fabric layers embrace the separator plate 410 with the upper fabric layer placed on the upper surface of the separator plate and the lower layer positioned on the undersurface of the separator plate. In such a case, in order to facilitate the insertion of the fabric pieces, each of the separator plate 410 and presser plate 412 is rounded at corners except for a corner where the plates are secured to the holder plate 395. And the portion of the separator plate 410 which faces the left-hand end or edge 412*a* of the presser plate is formed as having a ⌐-shape as seen in side elevation so as to position the left-hand portion 410*a* of the separator plate 410 slightly above the right-hand portion of the separator plate.

Figure 21:
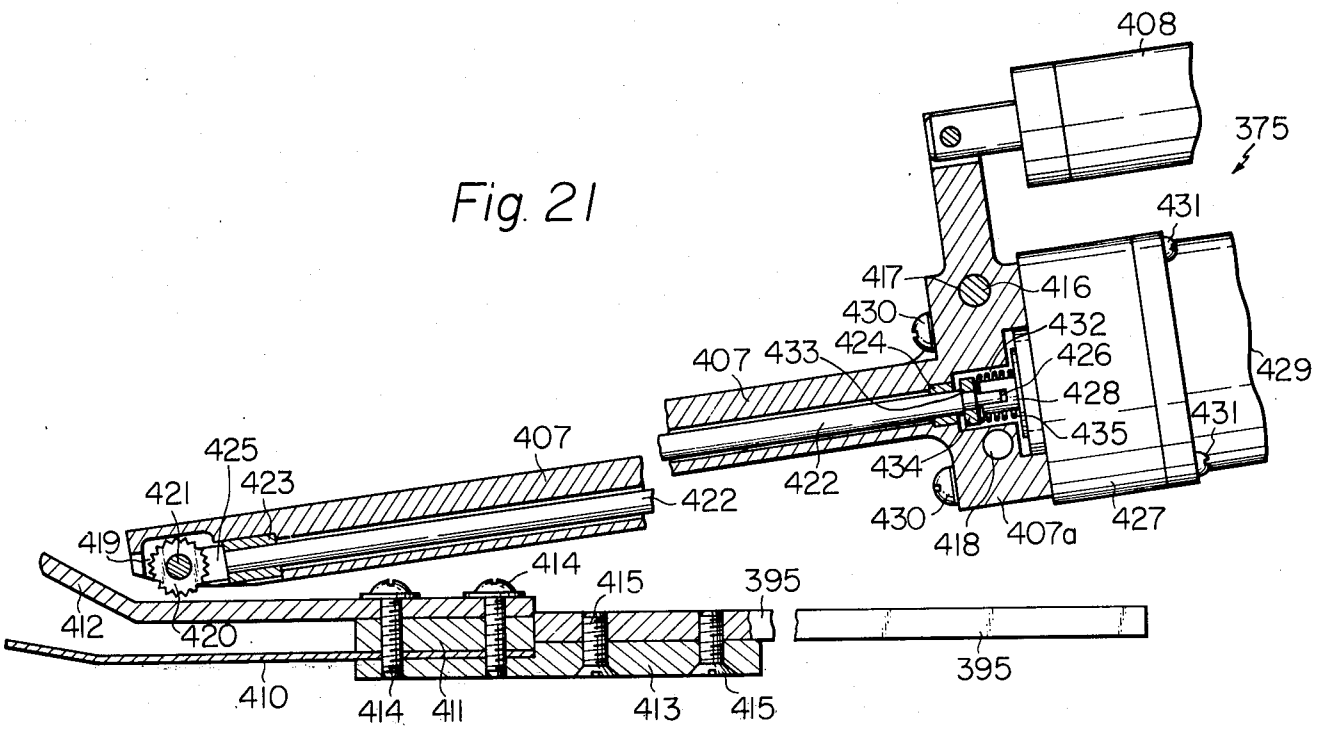

The arm 407 which constitutes an important part of the fabric piece positioning mechanism 377 bulges upwardly and downwardly at the base end thereof to form a supporting block 407*a* as more clearly shown in FIG. 21 and is pivotably mounted to the cover member 378 by means of a pin 416 at the supporting block 407*a*. In this embodiment, the cover member 378 has two through holes 417, and the supporting block 407*a* has two through holes 418 for receiving the pin 416. By selectively inserting the pin 416 into one of the two pairs of through holes 417, 418, the arm 407 can be mounted on the cover member 378 at a selected position with respect to the cover member. The arm 407 slopes downwardly from the supporting block 407*a* to the front end, and the front end of the arm extends beyond the needle center and faces the upper surface of the separator plate 410. The arm 407 has at the front end thereof a recess 419 opening downwardly, and a pinion 420 is rotatably mounted within the recess 419 by means of a pin 421 with the lower portion of the pinion projecting out of the recess. A power transmission shaft 422 extends within the arm 407 along the length of the arm and is journalled in bearings 423, 424 within the arm 407 so as to impart a rotational movement to the pinion 420. The front end or left-hand end of the power transmission shaft 422 has a crown gear 425 which is in meshing engagement with the pinion 420. The base end or right-hand end of the power transmission shaft 422 is connected through a tongue and groove coupling 426 to the shaft of a reduction gear 427 which is in turn connected to a reversible electric motor 429. The reduction gear 427 is secured to the supporting block 407*a* at the base end of the arm 407 by means of screws 430 and the electric motor 429 is secured to the reduction gear 427 by means of screws 431. Thus, the rotation of the electric motor 429 is transmitted to the pinion 420 through the reduction gear 427, power transmission shaft 422 and crown gear 425 to rotate the pinion about the pin 421. In this case, in order to positively maintain the meshing engagement between the crown gear 425 and pinion 420 at all the times, a large diameter opening 432 is provided at the base and extending in the axial direction of the arm and the portion of the transmission shaft 422 positioned within the opening 432 is stepped at 433 and receives a thurst bearing 434 thereon. A coiled spring 435 is disposed about the motor shaft 428 between the thrust bearing 434 and reduction gear 427 to normally bias the transmission shaft 422 leftwards. The air cylinder 408 adapted to rock the arm 407 about the pin 416 is rockably mounted at the base end of a bracket 437 by means of a pin 438 and the bracket is secured to the upper inner surface of the cover member 378 by means of a screw 436 as seen in FIG. 17. The front end of the piston rod 439 of the air cylinder 408 is pivoted by means of a pin 441 to the upper end of a connector arm 440 extending upwardly from the supporting block 407*a* of the arm 407. The detector member 406 which constitutes an important part of the fabric positioning mechanism 377 is substantially similar to the corresponding part (see FIG. 10) of the previous embodiment and is secured to the front end of the holder plate 395 by means of screws 473.

As more clearly shown in FIGS. 17 and 18, the lower manipulator means 376 comprises a stationary plate 442 which also serves as a corner plate for the sewing machine mechanism and a cover member 444 having a fabric layer position control mechanism 443 disposed below the stationary plate 442. The cover plate 444 is detachably secured by means of screws 445 to the stationary plate 442 which is in turn secured to the lower portion 344 of the sewing head by means of screws 446 and also serves as a corner plate for the sewing head lower portion 344. In this embodiment, the cover member 444 is fitted in a notch (not shown) in the table 330 and faces the upper manipulator means 375 with the table interposed therebetween. The arm 447 which constitutes an important part of the fabric layer position control mechanism 443 is similar in construction to the arm 407 of the upper manipulator means 375 and is pivotally mounted at the supporting block 447*a* at the base end of the arm to the cover member 444 by means of screws. The supporting block 447*a* is also selectively mounted on the cover member 444 by means of a pin 448 which can be selectively inserted in one of the holes in the cover member. The arm 447 extends rightwardly and slants upwardly from the supporting block 447*a* and the other or right-hand end of the arm is exposed through a through hole 450 which is commonly formed in the stationary plate 442 and the throat plate 449. A pinion 451 is rotatably mounted at the right-hand end of the arm 447 by means of a pin 452 and faces the pinion 420 of the upper manipulator means with the separator plate 410 interposed therebetween. Although not described in detail, the pinion 451 is rotated by the electric motor 456 through the reduction gear 455 fixedly mounted at the base end of the supporting block 447 as described in connection with the upper manipulator means 375. An air cylinder 457 for rotating the arm 447 about the pin 448 is rockably mounted at the base end by means of a pin 460 on a bracket 459 secured to the cover member 444 by means of a screw 458. The piston rod 461 of the air cylinder 457 is connected by means of a pin 463 to the adjacent end of a connector arm 462 depending from the supporting block 447*a* of the arm 447.

In order to properly set the fabric layers, the above-mentioned positioning piece 409 is juxtaposed with the detector member 406 and as shown in FIG. 18, the positioning piece 409 is formed of a block having an arcuate surrface 409*a* at the front or free end thereof and is secured at the base end thereof to the adjacent end of the holder plate 395 by means of screws 475. Thus, the fabric layers can be easily positioned and properly set by inserting the fabric layers to the position in which the free side edges of the fabric layers abut against the front end of the positioning piece 409.

Figure 23:
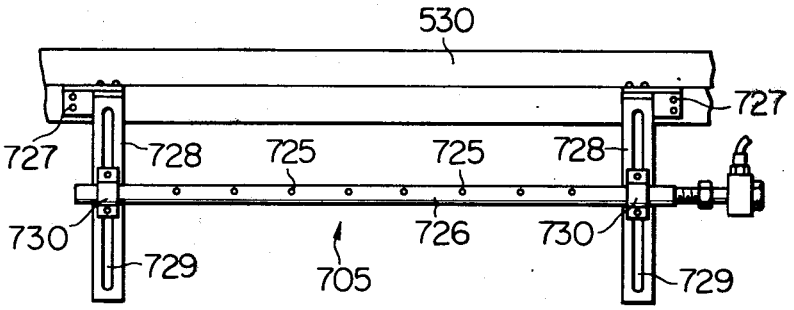

Referring now to FIGS. 22 and 23, in these Figures another embodiment of a table, a control box and a stacker including a blower is shown. As shown in FIG. 22, the base 529 of the sewing machine mechanism comprises a framework including four legs 531 and a pedestal 532 and bridges connecting the legs 531, and the table 530 includes side plates 522 depending from the undersurface of the table. The four legs 531 are each provided with elongated slots 534. The side plate 522 in turn is adjustably secured to the legs 531 by means of bolts 535 which extend through the slots 534 from the outer side of the side plate and connect the legs and side plates together. Thus, the table 530 can be moved with respect to the pedestal 532 by loosening the bolts 535 and set in any desired position or height along the legs by tightening the bolts.

The control box 528 is formed as a structure separate from the above-mentioned sewing machine mechanism and is operatively connected to the various mechanisms by means of a cable 556 including various signal lines and pipes.

As more clearly shown in FIG. 22, the stacker 627 comprises a pair of left- and right-hand supporting arms 606 secured to the base 529 in a position behind the sewing machine mechanism and a gripping bar 607 rockably mounted at the lower end thereof on the base 529 in a position between the supporting arms. Each of the supporting arms 606 comprises an L-shaped supporting member 608 connected at the left-hand end thereof to the bridge and a holder member 611 telescopically received on the upright portion of the L-shaped support member 608. The holder member 611 has an elongated slot 610 and is adjustably secured to the supporting member 608 by means of adjusting screws 609. The left- and right-hand supporting arms 606 are connected together by two parallel horizontal supporting rods 612 extending between the holder members 611. The gripping bar 607 also comprises a supporting member 613 and a gripping bar 615 telescopically received in the supporting member 613 and adjustably secured to the supporting member 613 by means of thumbscrews 614. The gripping bar 607 is also pivoted at the lower end thereof to the bridge so as to be pivoted by its associated air cylinder as in the case of the gripping bar 235 in the previous embodiment.

And as seen in FIG. 23, the blower 705 is formed of a porous pipe 726 having therein a number of air outlet holes 725 and is adjustably mounted to brackets 728 which are secured to the rear lower portion of the table. The opposite ends of the pipe 726 are adjustably secured to the brackets by means of connectors 730 and elongated slots 729 in the brackets.

With the above mentioned construction, the height or position of the table and stacker can be varied depending upon the length and other parameters of the fabric layers, and the control box for controlling the various elements of the sewing machine can be positioned in a desired position resulting in improvement of sewing operation efficiency.

Figure 24:
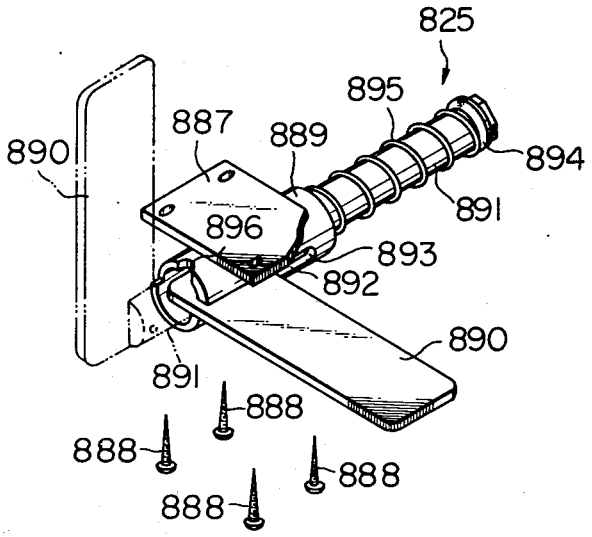
FIG. 24 is a perspective view of another embodiment of the auxiliary guide.

FIG. 24 shows another embodiment of auxiliary or guide 825 which comprises a guide sleeves 889 which is secured to the undersurface of the front end edge of the table by means of screws 888 with a mounting member 887 interposed therebetween, and a guide bar 891 which is telescopically received in the guide sleeve 889 and has a guide piece 890 extending laterally of the left-hand end as seen in FIG. 24. The guide sleeve 889 includes a guide groove 892 extending from a midpoint between the opposite ends of the guide sleeve 889 to the tip end thereof. A pin 893 projecting from the guide bar 891 extends throough the guide groove 892. A spring 895 is disposed between the rear or right end of the guide sleeve 889 and an abutment 894 at the left end of the guide bar 891. The biasing force of the spring 895 normally urges the guide piece 890 into it storage or retracted position below the undersurface of the table in the sewing machine mechanism. The guide piece 890 will be extended from the storage position against the biasing force of the spring 895 until the pin 893 ultimately comes off the guide groove 892. Then the guide bar is rotated by 90° to drop the pin 893 into a recess 896 formed in the left-hand end of the guide sleeve. The guide bar then assumes the position as shown by phantom lines in FIG. 24 in which the guide piece 890 assumes an upright position to engage the free side edges of the fabric layers to thereby prevent the fabric layers from displacing rightwardly by an excessively great distance.

While preferred embodiments of the present invention have been shown and described in detail it will be understood that they are not to be taken as a definition of the invention, reference being had for this purpose to the appended claims.

What is claimed is:

1. An automatic sewing machine comprising:

a sewing machine mechanism including a table, a seam forming mechanism for sewing two superposed layers of fabric together and a fabric feed mechanism, a detector member disposed upstream of said seam forming mechanism in a fabric feed direction and including a pair of detector elements each sensing individually each free side edge of said two layers of fabric and independently generating a signal representative thereof, a separator plate disposed upstream of said seam forming mechanism in said feed direction and adapted to be positioned between free side edges of said two layers of fabric, a first manipulator means adapted to engage the upper surface of the upper fabric layer on the upper side of said separator plate and having a pinion rotatable about an axis parallel to said fabric feed direction, a second manipulator means adapted to engage the lower surface of the lower fabric layer on the lower side of said separator plate and having a pinion rotatable about an axis parallel to said fabric feed direction, a pair of electric motors adapted to operate in response to signals from said detector member to individually rotate said pinions of said first and second manipulator means in forward and reverse directions to thereby positively position said free side edges of the two layers of fabric on said detector elements, a first pressure means adapted to apply the engaging force of said first manipulator means to the upper layer of fabric and release said engaging force from the layer, a second pressure means adapted to apply the engaging force of said second manipulator means to the lower layer of fabric and release said engaging force from the layer, and means for retracting said first and second manipulator means from said upper and lower layers of fabric, respectively, when said engaging forces of the first and second manipulator means are released from the layers of fabric.

2. An automatic sewing machine as set forth in claim 1, further including engaging force adjusting means adapted to individually adjust said engaging forces of the first and second pressure means against said layers of fabric to thereby individually adjust the engaging forces applied to said layers of fabric against said separator plate by said first and second manipulator means.

3. An automatic sewing machine as set forth in claim 1, further including an adjusting mechanism means for adjustably moving and setting said detector member in a direction intersecting said fabric feed direction so that a distance from the free side edges of layers of fabric to a predetermined seam forming position may be adjusted.

4. An automatic sewing machine as set forth in claim 1, further including an air table having means for applying air pressure against the undersurface of a portion of fabric remote from said fabric feed mechanism, as said fabric is fed on said table by said feed mechanism, in a direction compounding three directions including said fabric feed direction, a lateral direction intersecting said fabric feed direction and away from said detector member, and a vertical direction normal to said two directions.

5. An automatic sewing machine as set forth in claim 1, further including an auxiliary guide means disposed at the front edge of said machine table for applying a force to said fabric to displace the free side edges of the layers of fabric in a direction away from said detector member in relation to the movement of the layers of fabric by said fabric feed mechanism.

6. An automatic sewing machine comprising a sewing machine mechanism having a table, a presser foot, a lever for lifting said presser foot, and an electric motor mechanism having a clutch and a lever for operating said clutch, an air cylinder for operating said presser foot lifting lever, an air cylinder for shifting said clutch operation lever, an air table disposed at a selected position on said table and including a plurality of air holes which are slanted in the direction of advancement of the workpieces and which are arranged in a surface in contact with the workpieces so as to facilitate advancing movement of the workpieces, a stacker having supporting rods, a rockable gripping bar for gripping an intermediate portion of sewn workpieces in cooperation with said supporting rods when a sewing operation on the workpieces has been completed, blower means for blowing the trailing half portion of the sewn workpieces off said table to stack such trailing half portion of the workpieces onto said supporting rods while the sewn workpieces are being gripped by said gripping bar, controller means for effecting sequential control of the operation of driven elements of said sewing machine mechanism and the operation of said members associated with said sewing machine mechanism, a detector member means adapted to sense the position of free side edges of the workpieces to be sewn in response to an output signal from said controller means at least during a high speed forward sewing operation and to then provide an operation termination signal to said controller means upon the detection of the terminal end of the sewn workpieces, manipulator means operable in response to a signal representing the position of the free side edges of the workpieces from said detector member means to compensate for any deviation of the position of the free side edges of the workpieces, and an auxiliary guide means positioned at the front edge of said table to impart a clockwise moment to the workpieces as the workpieces are fed by the feed mechanism of the sewing machine mechanism, said auxiliary guide means including a sloped portion having an adjustable angle.

7. An automatic sewing machine as set forth in claim 6, wherein said controller means is an element separate from said sewing machine mechanism and is connected thereto by a cable.

8. An automatic sewing machine as set forth in claim 7, wherein the height of said table of said sewing machine mechanism and said stacker are adjustable.

* * * * *